US009531120B2

(12) United States Patent
Bates, III et al.

(10) Patent No.: US 9,531,120 B2
(45) Date of Patent: Dec. 27, 2016

(54) CIRCULAR CONNECTORS

(71) Applicant: Conesys, Inc., Torrence, CA (US)

(72) Inventors: Charles L. Bates, III, Laguna Hills, CA (US); Robert M. Edwards, Lomita, CA (US)

(73) Assignee: CONESYS, INC., Torrence, CA (US)

( * ) Notice: Subject to any disclaimer, the term of this patent is extended or adjusted under 35 U.S.C. 154(b) by 188 days.

(21) Appl. No.: 14/477,116

(22) Filed: Sep. 4, 2014

(65) Prior Publication Data

US 2016/0072221 A1 Mar. 10, 2016

(51) Int. Cl.

| | |
|---|---|
| ***H01R 13/62*** | (2006.01) |
| ***H01R 13/622*** | (2006.01) |
| ***H01R 13/533*** | (2006.01) |
| ***H01R 43/02*** | (2006.01) |
| *H01R 13/639* | (2006.01) |

(52) U.S. Cl.

CPC ..... *H01R 13/622* (2013.01); *H01R 13/533* (2013.01); *H01R 43/0207* (2013.01); *H01R 13/639* (2013.01)

(58) Field of Classification Search

CPC ..... H01R 13/622

See application file for complete search history.

(56) References Cited

U.S. PATENT DOCUMENTS 4,152,039 A 5/1979 Shah
4,239,314 A 12/1980 Anderson et al.
4,239,315 A 12/1980 Lacaze, Jr.
4,268,103 A 5/1981 Schildkraut et al.
4,291,933 A * 9/1981 Kakaris ..... H01R 13/622 439/321
4,462,652 A 7/1984 Werth et al.
4,478,473 A 10/1984 Frear
4,478,474 A 10/1984 Gallusser et al.
4,484,790 A * 11/1984 Schildkraut ..... H01R 13/622 439/312
4,487,470 A 12/1984 Knapp et al.

(Continued)

FOREIGN PATENT DOCUMENTS

EP 0137920 A1 4/1985
EP 0189343 A2 7/1986

(Continued)

*Primary Examiner* — James Harvey
(74) *Attorney, Agent, or Firm* — K&L Gates LLP

(57) ABSTRACT

Electrical connector assemblies are disclosed. An electrical connector assembly comprises a first shell comprising an externally threaded portion, a second shell comprising an outer surface, a coupling nut, and an annular insert secured within the coupling nut and positioned around the second shell. A first shell and a second shell include mating alignment features. An outer surface of a second shell comprises an unthreaded portion, which comprises a plurality of recesses arranged around an annular track. A coupling nut comprises an internally threaded portion, which is configured to threadably engage an externally threaded portion of a first shell. An annular insert is comprised of a plastic material, and comprises an inner surface comprising a plurality of deflectable spring-loaded teeth that extending radially inward. A spring-loaded tooth is positioned around an unthreaded portion of a second shell and can be rotatably aligned with recesses defined therein.

11 Claims, 31 Drawing Sheets

(56) References Cited

U.S. PATENT DOCUMENTS

| | | | | |
|---|---|---|---|---|
| 4,502,748 | A | 3/1985 | Brush, Sr. et al. | |
| 4,508,408 | A * | 4/1985 | Shepler | H01R 13/622 439/313 |
| 4,519,661 | A | 5/1985 | Brush, Sr. et al. | |
| 4,588,245 | A | 5/1986 | Schwartz et al. | |
| 4,648,670 | A | 3/1987 | Punako et al. | |
| 5,376,015 | A | 12/1994 | Fuchs et al. | |
| 5,681,177 | A | 10/1997 | Mikolaicyk et al. | |
| 6,152,753 | A * | 11/2000 | Johnson | H01R 13/622 439/312 |
| 7,625,226 | B1 | 12/2009 | Gastineau | |
| 7,905,741 | B1 * | 3/2011 | Wade | H01R 13/622 439/321 |
| 7,914,311 | B1 * | 3/2011 | Gallusser | H01R 13/639 439/321 |
| 8,550,742 | B2 | 10/2013 | Leroyer | |
| 8,579,644 | B2 * | 11/2013 | Cole | H01R 13/533 439/312 |
| 2002/0048984 | A1 * | 4/2002 | Scholler | H01R 13/622 439/321 |
| 2008/0012330 | A1 * | 1/2008 | Leroyer | H01R 13/622 285/386 |
| 2010/0099290 | A1 * | 4/2010 | Gastineau | H01R 13/639 439/321 |
| 2016/0072221 | A1 * | 3/2016 | Bates, III | H01R 13/533 439/352 |

FOREIGN PATENT DOCUMENTS

| | | | |
|---|---|---|---|
| EP | 0247814 | A2 | 12/1987 |
| EP | 0589770 | A1 | 3/1994 |
| EP | 2362494 | A1 | 8/2011 |
| JP | 2003086295 | A | 3/2003 |

* cited by examiner

CIRCULAR CONNECTORS

FIELD

The present disclosure relates to circular connector assemblies for electrical contacts and methods for making and assembling the same.

BACKGROUND

Circular connectors can be used to connect a variety of different types of electrical contacts and in various different environments. When circular connectors are used in high vibration environments, it may be desirable to incorporate an anti-vibration or anti-decoupling mechanism. For example, circular connector for high-vibration environments may employ a spring-loaded detent and/or ratchet mechanism to prevent and/or limit undesirable rotation, and possible decoupling, of the connector components.

Many currently available anti-decoupling mechanisms employ at least one metallic component, such as a metallic spring, detent, and/or fastener, for example. Accordingly, even plastic connectors may include at least one metallic component. The resultant metal-to-plastic contact can cause undesirable wear issues, as well as insufficient and/or inconsistent torque. Moreover, the metallic component(s) necessitates the addition of extra components, which can increase manufacturing costs, assembly time, and/or assembly complexity.

Circular connectors are available in a variety of standard sizes. In various circumstances, it is desirable to retrofit a circular connector assembly with an anti-decoupling mechanism for high vibration environments.

The foregoing discussion is intended only to illustrate various aspects of the related art in the field at the time and should not be taken as a disavowal of claim scope.

SUMMARY

In at least one embodiment, an electrical connector can comprises a first shell comprising an external threaded portion, a second shell comprising an outer surface, a coupling nut, and an annular insert secured relative to the coupling nut. The outer surface of the second shell can comprise an unthreaded portion, and the unthreaded portion can comprises a plurality of recesses arranged around an annular track. The coupling nut can comprise an internal threaded portion, which can be configured to threadably engage the external threaded portion of the first shell. The annular insert can comprise an inner surface comprising a plurality of spring-loaded teeth extending radially inward. The spring-loaded teeth can be positioned around the unthreaded portion of the second shell and can be rotatably aligned with the recesses in the second shell.

Additionally, the annular insert can be comprised of a plastic material. The plurality of spring-loaded teeth can comprise at least six teeth. The annular insert can comprise a body and a plurality of springs, and each spring can further comprise a first end connected to the body, a second end connected to the body, and at least one of the spring-loaded teeth intermediate the first end and the second end. Furthermore, the body can comprise a plurality of guide surfaces. At least one guide surface can be positioned intermediate adjacent springs, and the guide surfaces can be configured to rotatably slide along a portion of the unthreaded portion of the second shell.

Moreover, the unthreaded portion of the second shell can further comprise a locking rib and a flange, and the annular insert can be retained between the locking rib and the flange. Additionally, the electrical connector can further comprise a cover positioned intermediate the annular insert and the locking rib of the second shell. The cover and the annular insert can be snap-fit around the outer surface of the second shell. The outer surface of the second shell can further comprise a raised lip, and the plurality of recesses can be defined into the raised lip.

Furthermore, the coupling nut can further comprise a plurality of pins, the annular insert can further comprise a plurality of apertures, and each of the pins can be positioned in one of the apertures. The coupling nut can further comprises a plurality of axial ridges, the annular insert can further comprise a plurality of axial grooves, and each of the axial grooves can be dimensioned and positioned to receive one of the axial ridges. The annular insert can be ultrasonically welded to the coupling nut. The electrical connector can further comprise a biasing sleeve positioned around a portion of the outer surface of the second shell, wherein the biasing sleeve is configured to bias the external threaded portion of the first shell toward the internal threaded portion of the coupling nut when the coupling nut threadably engages the first shell.

The first shell can further comprise an inner surface comprising a plurality of first alignment features, wherein the outer surface of the second shell further comprises a plurality of second alignment features, and wherein the second alignment features are dimensioned to engage the first alignment features to resist rotation of the first shell relative to the second shell. The first shell can further comprise first electrical connections, and the second shell can further comprise second electrical connections dimensioned and positioned to mate with the first electrical connections.

In at least one form, an electrical connector, can comprise a first shell comprising an external threaded portion, a second shell comprising an outer surface, and a coupling nut. The outer surface of the second shell can comprise a plurality of recesses arranged in an annular row. The coupling nut can comprise an internal threaded portion configured to threadably engage the external threaded portion of the first shell, a plurality of guide surfaces, and a plurality of springs. The guide surfaces can be configured to rotatably slide along a portion of the outer surface of the second shell. Each spring can be positioned intermediate a pair of the guide surfaces, and each spring can comprise a first end, a second end, and a spring-loaded tooth intermediate the first end and the second end. The guide surfaces can be positioned radially inward of the spring-loaded teeth, and the spring-loaded teeth can be rotatably aligned with the recesses in the second shell.

Additionally, the springs can further comprise an arc extending radially inward between the first end and the second end.

In at least one form, an electrical connector can comprise a first shell comprising an external thread, a second shell comprising an outer surface, a coupling nut comprised of a first plastic material, and an annular insert comprised of a second plastic material. The outer surface of the second shell can comprise a plurality of recesses arranged along an annular row. The coupling nut can comprise an internal thread. The annular insert can be fixed relative to the coupling nut. The annular insert can comprise an inner surface comprising a plurality of spring-loaded teeth extending radially inward, wherein the spring-loaded teeth are aligned with the annular row in the second shell.

Moreover, the first plastic material and the second plastic material can comprise the same plastic material. The coupling nut can further comprise a plurality of pins, the annular insert can further comprise a plurality of apertures, and each of the pins can be positioned in one of the apertures.

DESCRIPTION OF THE FIGURES

The features and advantages of this invention and the manner of attaining them will become more apparent and the invention itself will be better understood by reference to the following description of embodiments of the invention taken in conjunction with the accompanying drawings, in which.

DETAILED DESCRIPTION

Figure 1:
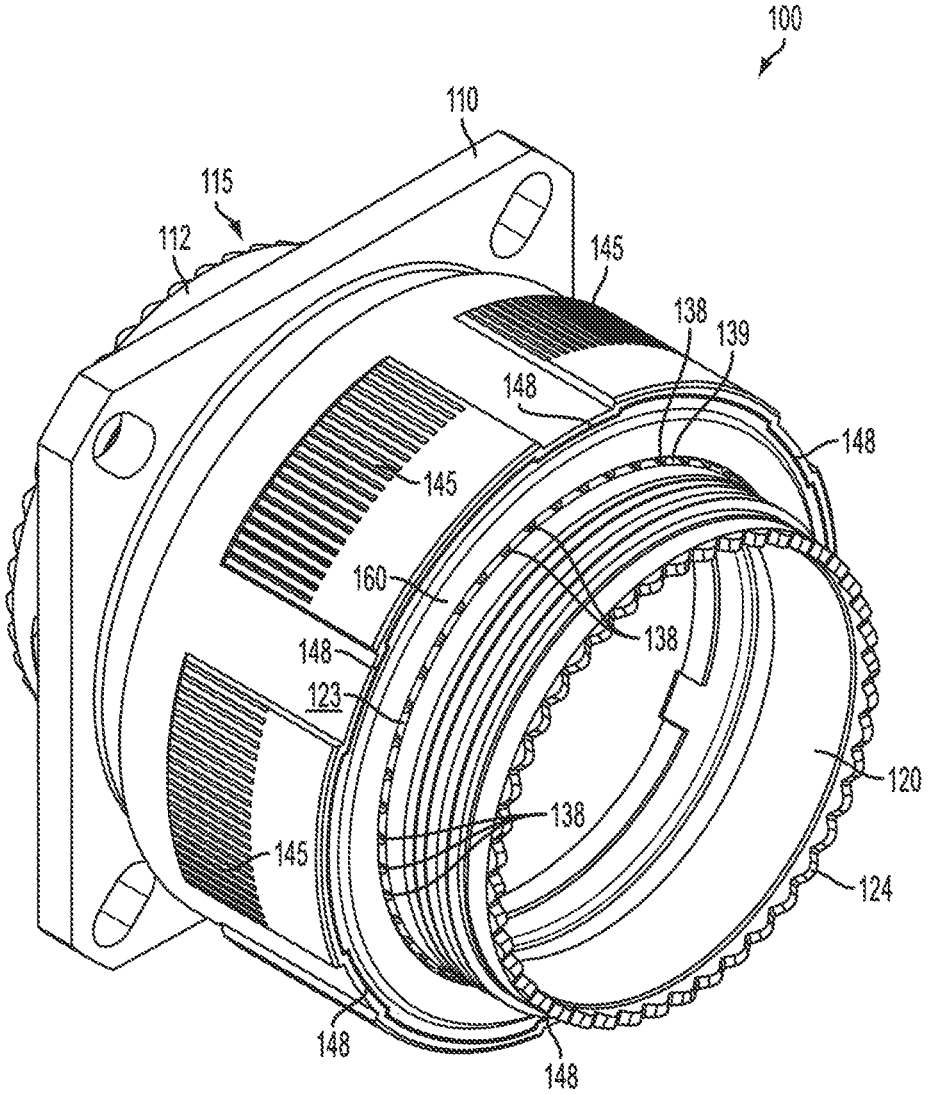
FIG. 1 is a perspective view of a circular connector assembly for electrical contacts, according to various embodiments of the present disclosure.

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments of the present invention is defined solely by the claims. The features illustrated or described in connection with one exemplary embodiment may be combined with the features of other embodiments. Such modifications and variations are intended to be included within the scope of the present invention.

Reference throughout the specification to "various embodiments," "some embodiments," "one embodiment," or "an embodiment", or the like, means that a particular feature, structure, or characteristic described in connection with the embodiment is included in at least one embodiment. Thus, appearances of the phrases "in various embodiments," "in some embodiments," "in one embodiment", or "in an embodiment", or the like, in places throughout the specification are not necessarily all referring to the same embodiment. Additionally, reference throughout the specification to "various instances," "some instances," "one instance," or "an instance", the like, means that a particular feature, structure, or characteristic described in connection with the instance is included in at least one instance. Thus, appearances of the phrases "in various instances," "in some instances," "in one instance", "in an instance", or the like, in places throughout the specification are not necessarily all referring to the same instance.

Furthermore, the particular features, structures, or characteristics may be combined in any suitable manner in one or more embodiment or instance. Thus, the particular features, structures, or characteristics illustrated or described in connection with one embodiment or instance may be combined, in whole or in part, with the features structures, or characteristics of one or more other embodiment or instance without limitation. Such modifications and variations are intended to be included within the scope of the present invention.

In various embodiments, a circular connector assembly can include a first shell that houses at least one electrical contact, a second shell that houses at least one corresponding electrical contact, and a coupling nut that is configured to secure the first shell and the second shell together to physically connect and electrically couple the electrical contacts. When the first shell and the second shell are assembled together, rotation of the first shell relative to the second shell can be limited and/or prevented. For example, the first shell and the second shell can include alignment features, which prevent rotation of the first shell relative to the second shell. It may be desirable to prevent rotation of the first shell relative to the second shell to maintain alignment of the electrical contacts and to avoid damage thereto.

An annular insert can be inserted into the coupling nut, and can be held in a fixed positioned relative to the coupling nut. When assembled, the coupling nut and the annular insert can be axially restrained around the second shell; however, the coupling nut and the annular insert can be configured to rotate relative to the second shell. For example, the annular insert can be snap-fit or otherwise secured between a locking flange and a locking rib that protrude from the outer surface of the second shell. Additionally, the annular insert can include flexible spring members, which engage an annular track of recesses in the outer surface of the second shell. The geometry of the recesses can permit rotation of the annular insert relative to the second shell; however, such rotation can be controlled and/or restrained.

In various instances, as the coupling nut and the annular insert therein rotate in a coupling direction relative to the second shell, the coupling nut can be configured to threadably engage a threaded portion on the first shell to draw the first shell toward the second shell. Moreover, rotation of the coupling nut and the annular insert in the decoupling direction can be resisted by the engagement of the spring members with the recesses defined in the outer surface of the second shell. The shells, annular insert, and coupling nut can be comprised of a plastic material such that metal-to-plastic contacts between the rotating components is avoided. For example, the annular insert can consist of a unitary molded piece, and the spring members can be integrally formed parts of the unitary molded piece.

An exemplary embodiment of a circular connector assembly 100 and various components thereof are depicted in FIGS. 1-12. The reader will appreciate that various features illustrated and/or described with respect to circular connector assembly 100 can be combined with the features of other embodiments. The circular connector assembly 100 includes a first shell 110, a second shell 120, a coupling nut 140, an annular insert 150 and a protective cover 160. Referring still to FIGS. 1-12, the first shell 110 can form a receptacle shell and the second shell 120 can form a plug shell. Accordingly, the receptacle shell 110 can include an opening that is structured and dimensioned to receive the plug shell 120 therein. In other instances, the first shell 110 can form a plug for the second shell 120, and the second shell 120 can form a receptacle for the first shell 110, for example.

Although not depicted in FIGS. 1-12, the first shell 110 and the second shell 120 can each include a housing and electrical contacts can be housed therein. For example, the first shell 110 can include a first housing and at least one pin connection housed therein, and the second shell 120 can include a second housing and at least one socket connection housed therein, for example. When fully assembled (see, e.g., FIGS. 1 and 4), the circular connector assembly 100 can physically connect and electrically couple the pin connection(s) housed within the first shell 110 to the socket connection(s) housed within the second shell 120. Exemplary pin connections are depicted in FIGS. 21-27, however, the reader will appreciate that the circular connector assembly 100 and various other circular connectors described herein, e.g., circular connector assemblies 200 (FIGS. 13A-20), 300 (FIGS. 21-27), 400 (FIG. 28), and 500 (FIG. 29), can be used with different types and/or numbers of electrical contacts, as well as various different arrangements thereof.

As described in greater detail herein, the coupling nut 140 can be secured to one of the first shell 110 or the second shell 120, and can threadably engage the other of the first shell 110 or the second shell 120. The coupling nut 140 can be secured to the second shell 120, for example, and can threadably engage the first shell 110, for example. In such instances, internal threads 146 of the coupling nut 140 can threadably engage external threads 116 of the first shell 110, and coupling rotation of the coupling nut 140 relative to the first shell 110 can draw the first shell 110 axially toward the second shell 120. Moreover, decoupling rotation of the coupling nut 140 relative to the first shell 110 can draw the first shell 110 axially away from the second shell 120.

In various instances, the annular insert 150 can be retained within the coupling nut 140. The annular insert 150 can engage the second shell 120 (see, e.g., FIG. 8) to resist rotation between the annular insert 150 and the second shell 120, and thus, can resist rotation between the coupling nut 140 and the second shell 120. Because rotation between the coupling nut 140 and the second shell 120 is restrained and/or controlled, the circular connector assembly 100 can resist decoupling of the first shell 110 and the second shell 120 even when subjected to extreme conditions, such as high-vibration environments. More specifically, when the first shell 110 and the second shell 120 are connected, as described in greater detail herein, the shells 110, 120 may not be permitted to rotate independently, but rather, can rotate together. In such instances, restrained rotation of the coupling nut 140 relative to the second shell 120 corresponds to restrained rotation of the coupling nut 140 relative to the first shell 110 and, as a result, decoupling rotation of the coupling nut 140 relative to the first shell 110 is restrained via the engagement between the annular insert 150 fixed within the coupling nut 140 and the second shell 120.

Referring primarily to FIGS. 2, 4, 5, and 7, the first shell 110 can include a first end 112 and a second end 114. The externally threaded portion or external threads 116 of the first shell 110 can be positioned at and/or near the second end 114, and an attachment portion 115 can be positioned at and/or near the first end 112. The attachment portion 115 can be configured to attach the first shell 110 to another structure and/or electrical device, for example, and can be threaded and/or can include other fastening or attachment features, for example.

In various instances, the first shell 110 can also include at least one alignment feature 118 (see, e.g., FIG. 2), for example. The alignment feature 118 can extend from at and/or near the second end 114 toward the first end 112. The alignment feature(s) 118 can be structured, dimensioned and/or positioned to mate with corresponding alignment feature(s) 128 (see, e.g., FIG. 2) on the second shell 120. Mating engagement between the alignment features 118 and 128 can guide and/or facilitate axial connection of the first shell 110 and the second shell 120. For example, each alignment feature 118 can include at least one longitudinal and/or axially extending groove and the alignment feature 128 can include at least one longitudinal and/or axially extending rib. The grooves 118 can slidably receive the ribs 128 to connect the first shell 110 and the second shell 120, and can also prevent rotation between the first shell 110 and the second shell 120, for example.

Additionally or alternatively, the first shell 110 can include at least one rib and the second shell 120 can include at least one groove, for example. The reader will appreciate that various styles and/or arrangements of alignment features can be utilized to prevent rotation between the first shell 110 and the second shell 120 and that suitable variations are applicable to the circular connector assemblies described herein.

Referring primarily to FIGS. 2, 4, 5, 7, and 8 the second shell 120 can include a first end 122 and a second end 124, and the at least one alignment feature 128 (see, e.g., FIG. 2) can extend from at and/or near the first end 122 toward the second end 124. Moreover, an attachment portion 125 can be positioned at and/or near the second end 124. The attachment portion 125 can be configured to attach the second shell 120 to another structure and/or electrical device, for example, and can be threaded and/or can include other fastening or attachment features, for example.

Referring to the second shell 120 depicted in the embodiments of FIGS. 1-12, the second shell 120 can also include an outer surface 123 intermediate the first end 122 and the second end 124. The outer surface 123 can include at least one locking feature for securing the second shell 120 relative to the coupling nut 140. For example, as described in greater detail herein, the locking features on the outer surface 123 of the second shell 120 can engage the annular insert 150 and/or can directly engage the coupling nut 140 to secure the second shell 120 relative to the coupling nut 140 while permitting restrained and/or controlled rotation of the second shell 120 relative to the coupling nut 140. The locking features can be defined on an unthreaded portion of the outer surface 123.

Figure 2:
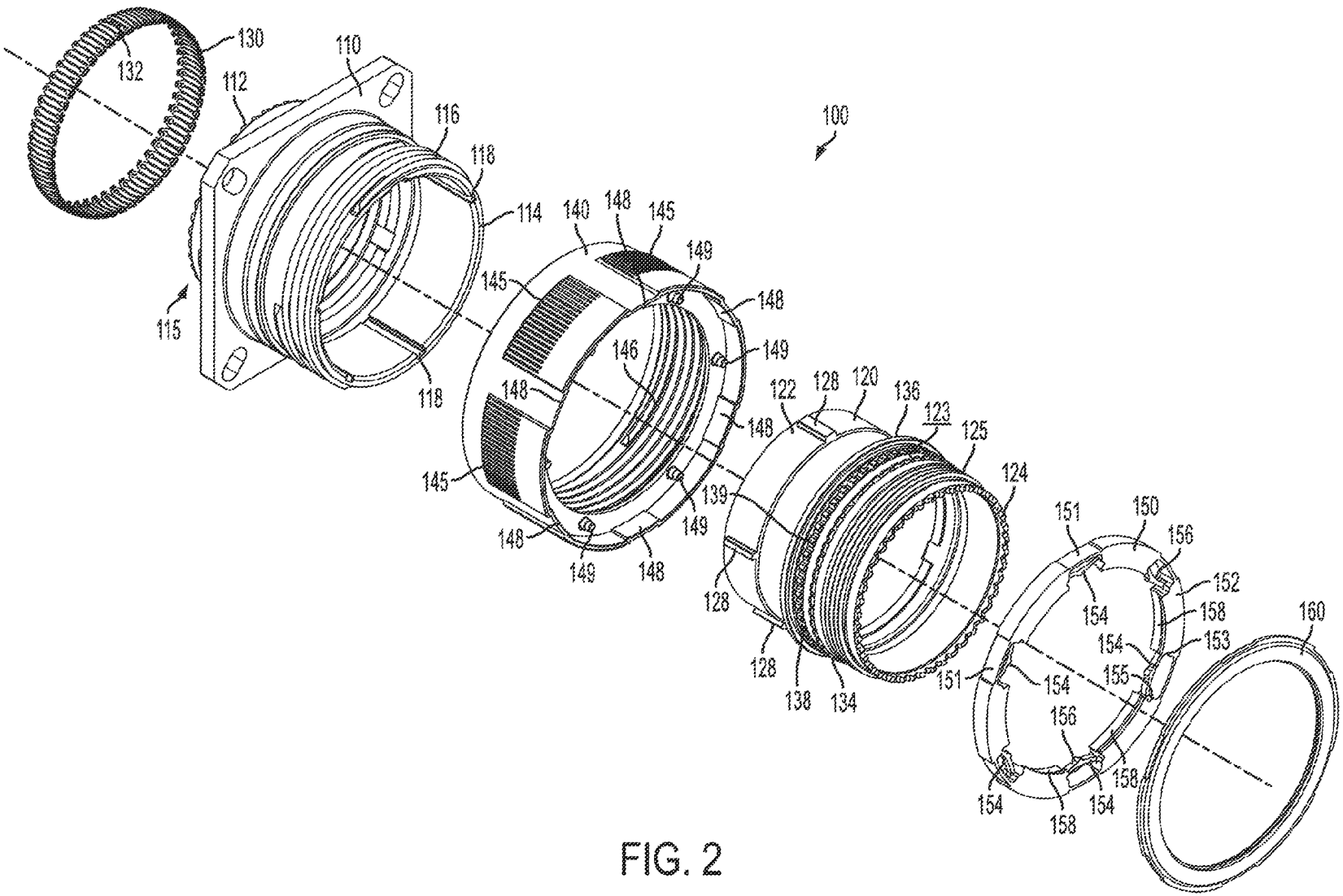
FIG. 2 is a perspective, exploded view of the circular connector assembly of FIG. 1, according to various embodiments of the present disclosure.
Figure 3:
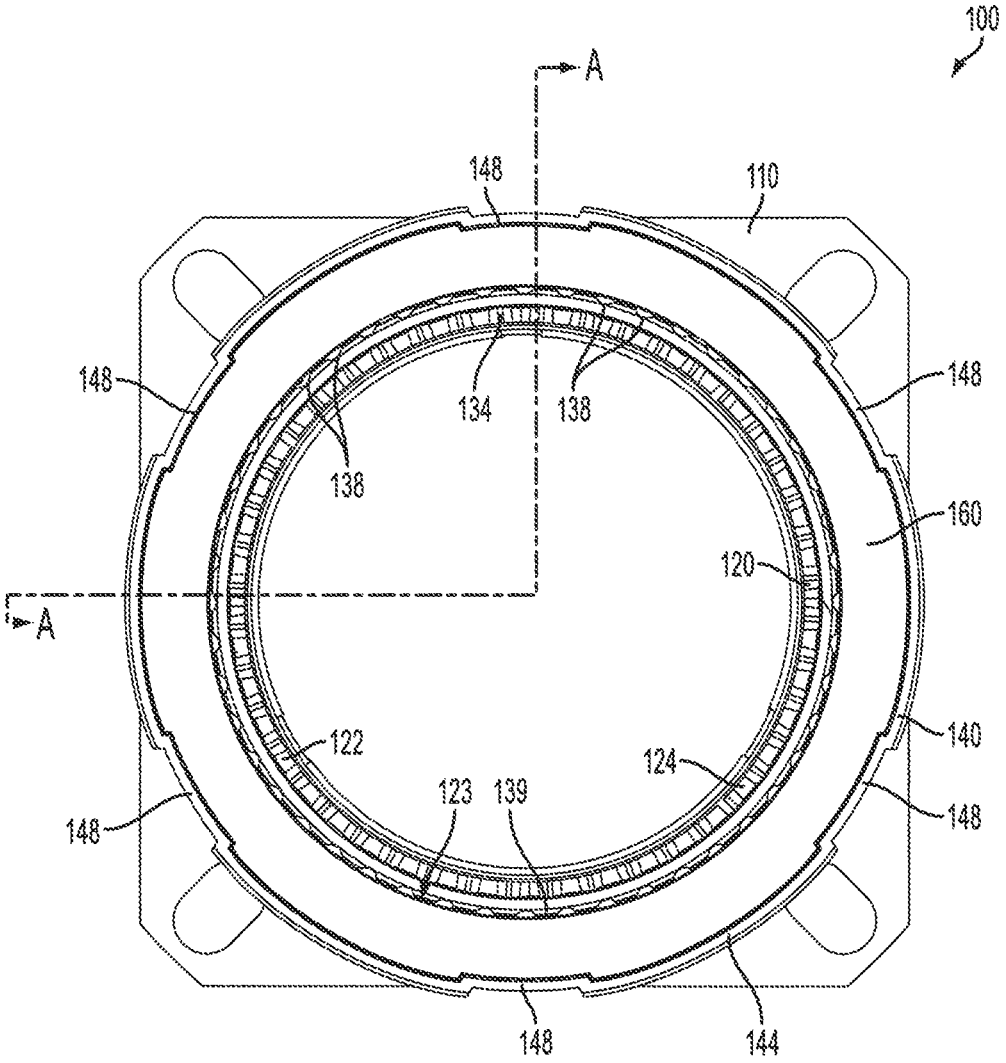
FIG. 3 is an elevation view of the circular connector assembly of FIG. 1, according to various embodiments of the present disclosure.
Figure 5:
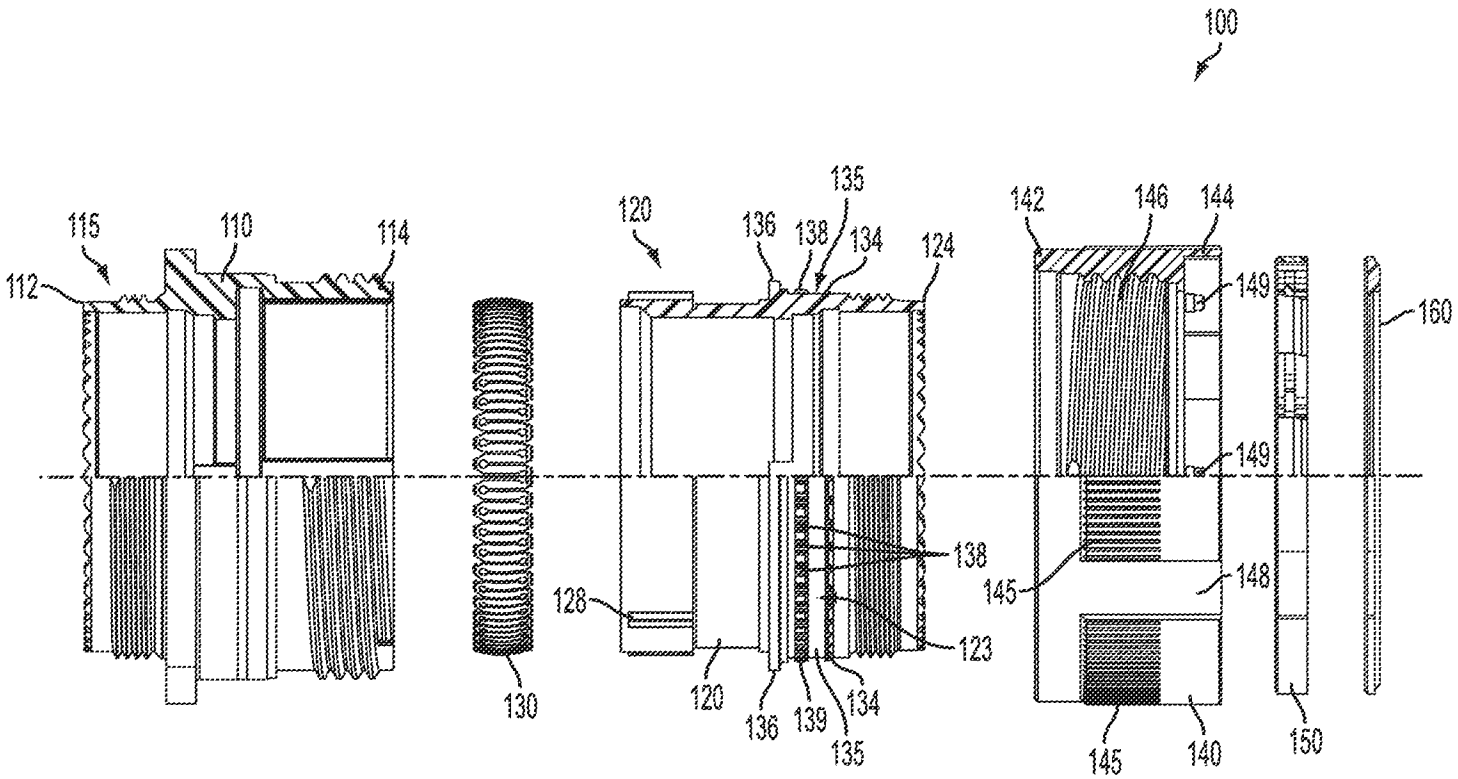
FIG. 5 is a quarter cross-sectional, exploded view of the circular connector assembly of FIG. 1 taken along the section lines A-A depicted in FIG. 3, according to various embodiments of the present disclosure.
Figure 6:
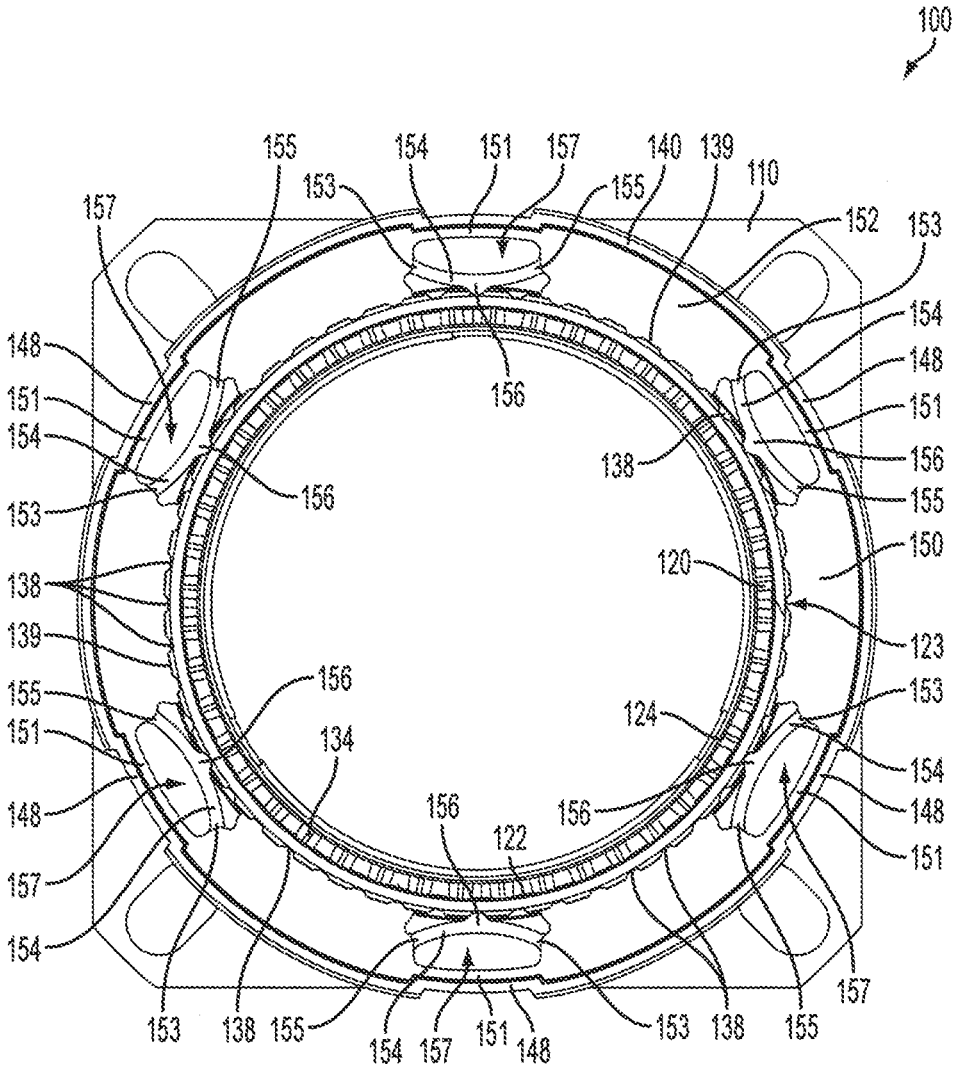
FIG. 6 is an elevation view of the circular connector assembly of FIG. 1 illustrated with a protective cover removed for illustration, according to various embodiments of the present disclosure.
Figure 7:
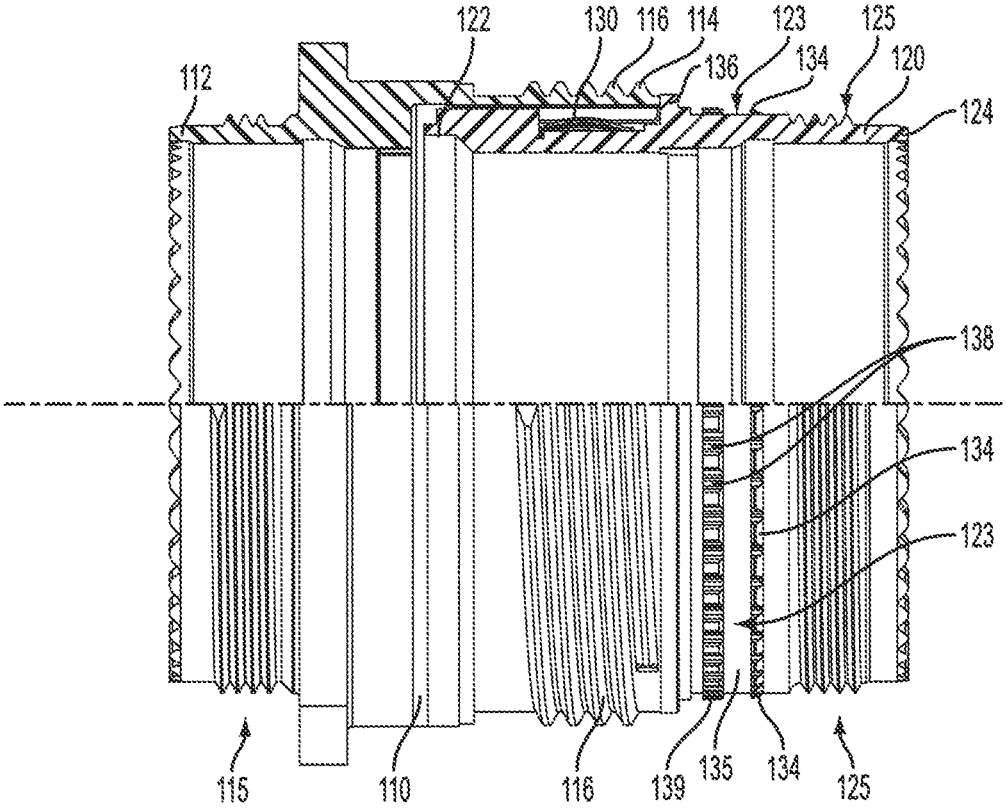
FIG. 7 is a quarter cross-sectional, elevation view of a first shell and a second shell of the circular connector assembly of FIG. 1 taken along the section lines A-A depicted in FIG. 3, according to various embodiments of the present disclosure.
Figure 8:
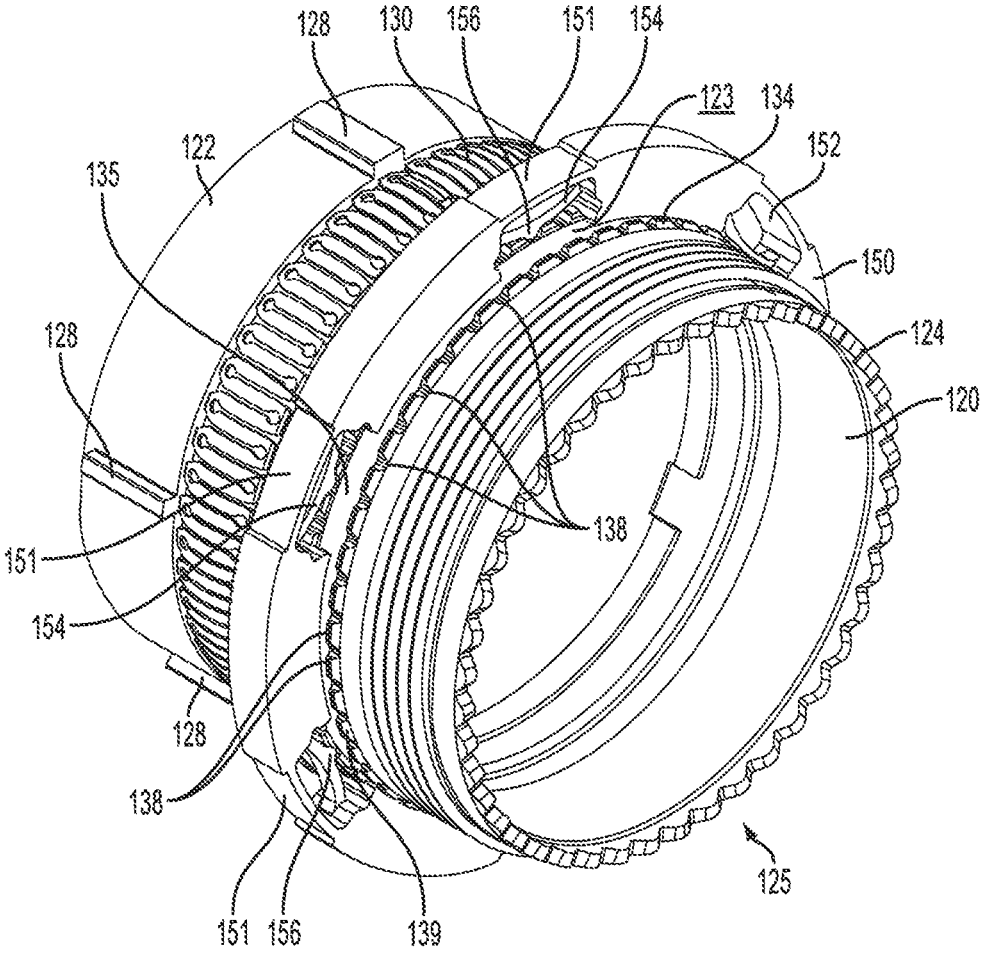
FIG. 8 is a perspective view of the first shell, the second shell, and an annular insert of the circular connector assembly of FIG. 1, according to various embodiments of the present disclosure.

Referring primarily to FIGS. 2, 5 and 8, the outer surface 123 of the second shell 120 includes a plurality of locking features, which engage the annular insert 150. For example, the outer surface 123 of the second shell 120 includes a locking rib 134 and a flange 136. Referring primarily to FIG. 7, when the first shell 110 and the second shell 120 are assembled together, the second end 112 of the first shell 110 can be positioned at and/or near the flange 136. For example, the second end 112 can be in abutting engagement with the flange 136, which can extend annularly outward from the outer surface 123.

Figure 4:
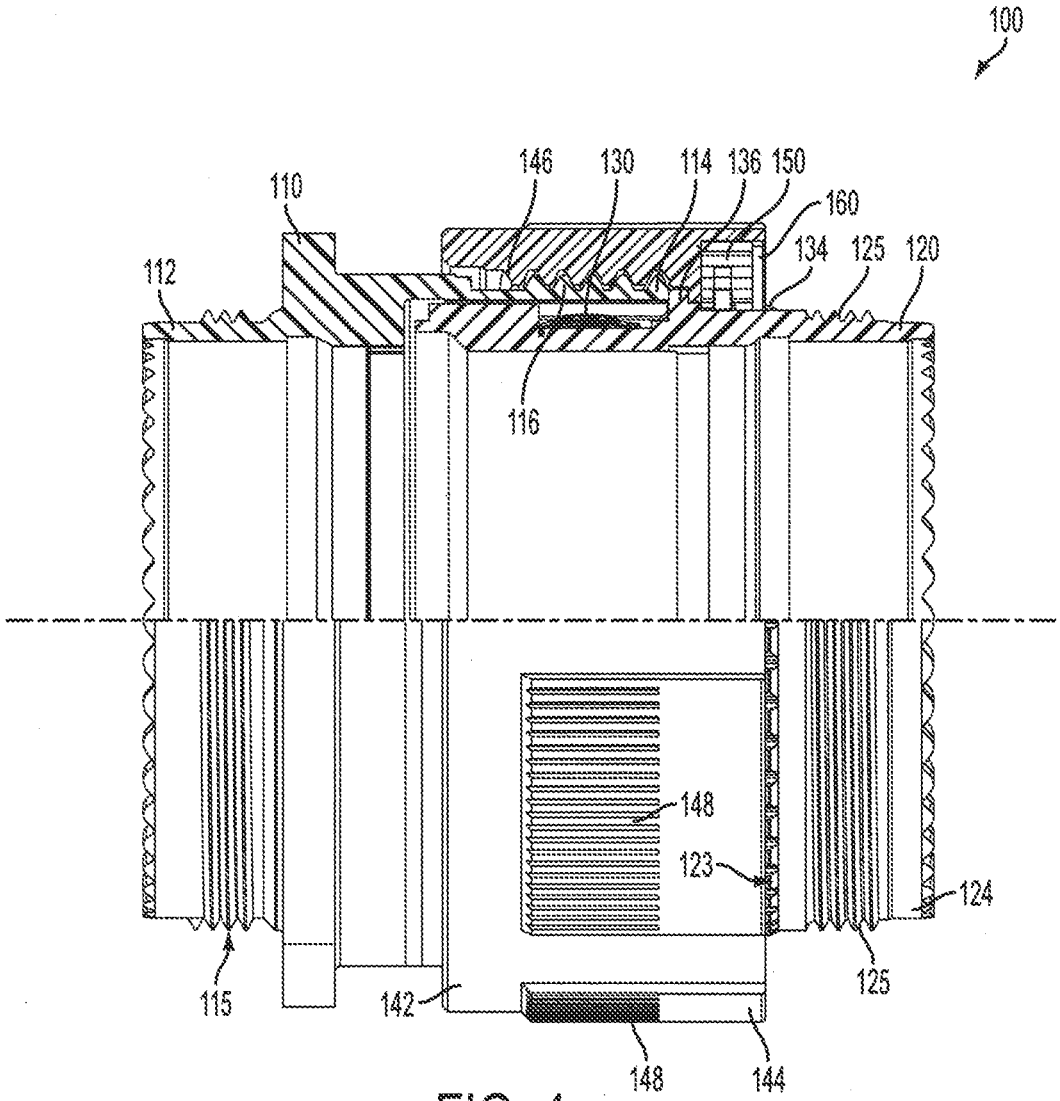
FIG. 4 is a quarter cross-sectional, elevation view of the circular connector assembly of FIG. 1 taken along the section lines A-A depicted in FIG. 3, according to various embodiments of the present disclosure.

Referring still to FIG. 7, the locking rib 134 can include a sloped profile facing the second end 124 of the second shell 120 and an abrupt and/or less-sloped profile facing the first end 122 and/or the flange 136 of the second shell 120. In various instances, as depicted in FIGS. 4 and 8, the annular insert 150 can be retained between the locking rib 134 and the flange 136. For example, the annular insert 150 can be snap-fit over the sloped-profile side of the locking rib 134, and can be held between the abrupt-profile side of the locking rib 134 and the flange 136.

A track 139 of grooves 138 can also be defined into the outer surface 123 of the second shell 120 intermediate the locking rib 134 and the flange 136. For example, the plurality of grooves 138 can be arranged at least partially around the annular track 139 on the outer surface 123 of the second shell 120. When the annular insert 150 is secured between the locking rib 134 and the flange 136 (see, e.g., FIG. 8), the annular insert 150 can rotate around the annular track 139 and can interface with the grooves 138 as it rotates. In certain instances, the track 139 can form a raised lip intermediate the locking rib 134 and the flange 136, and the grooves 138 can be defined into the raised lip.

As described in greater detail herein, the annular insert 150 can include flexible spring members 154, which can operably engage and disengage the grooves 138 to permit restrained rotation between the second shell 120 and the annular insert 150. In various instances, the outer surface 123 of the second shell 120 can also include an annular path or recess 135 intermediate the locking rib 134 and the flange 136. As the annular insert 150 rotates relative to the second shell 120, a portion of the annular insert 150 can slide and/or glide along the annular path 135. The annular path 135 can form a flat surface and/or can have a surface profile that partially matches the profile of guide surfaces 158 on the annular insert 150, for example.

Referring primarily to FIG. 8, a biasing sleeve 130 can be positioned around the second shell 120. In certain instances, a clip 132 can connect opposite ends of the biasing sleeve 130, such that the biasing sleeve 130 is securely positioned around the second shell 120. For example, the biasing sleeve 130 can be positioned intermediate the annular flange 136 and the alignment features 128. When the first shell 110 and the second shell 120 are assembled (see, e.g., FIGS. 4 and 7), the biasing sleeve 130 can be positioned therebetween. In various instances, the biasing sleeve 130 can frictionally engage the first shell 110 and the second shell 120 and can seek to further prevent and/or limit relative movement between the first shell 110 and the second shell 120. The biasing sleeve can be comprised of metal, such as a beryllium copper alloy, for example. In other instances, the biasing sleeve can be comprised of additional and/or different metallic materials and/or non-metallic materials.

Figure 9:
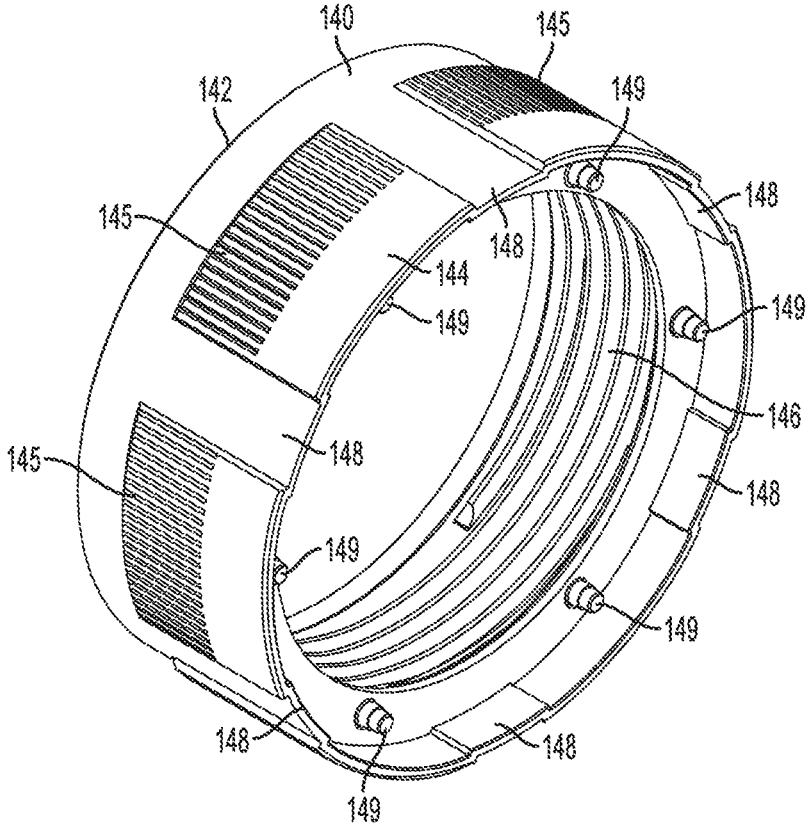
FIG. 9 is a perspective view of a coupling nut and a resistance ring of the circular connector assembly of FIG. 1, according to various embodiments of the present disclosure.
Figure 10:
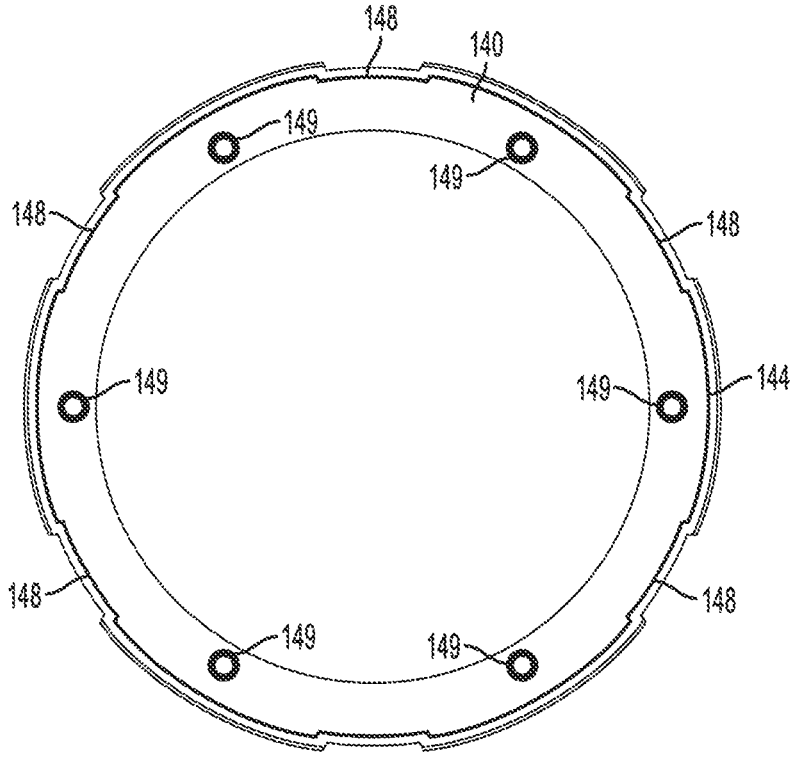
FIG. 10 is an elevation view of the coupling nut of FIG. 9, according to various embodiments of the present disclosure.

Referring primarily to FIGS. 9 and 10, the coupling nut 140 can include a first end 142 and a second end 144. An internally threaded portion 146 can extend from at and/or near the first end 142 toward the second end 144. The internal threads 146 can threadably engage the external threads 116 on the first shell 110, for example, to draw the second shell 120 toward the first shell 110. In various instances, the coupling nut 140 can include a grip 145 (see, e.g., FIG. 9), which can facilitate rotation of the coupling nut 140. For example, a plurality of gripping portions 145 can be positioned around the outer surface of the coupling nut 140.

In various instances, the coupling nut 140 can retain the annular insert 150 therein. For example, when assembled, the annular insert 150 can be fixed relative to the coupling nut 140. Accordingly, the coupling nut 140 can include a plurality of retaining features, which can engage corresponding retaining features on the annular insert 150. In various instances, the coupling nut 140 can include axially extending retaining features and/or radially extending retaining features. For example, the coupling nut 140 can include at least one axially extending pin 149, which can extend toward the second end 144 of the coupling nut 140. As depicted in FIGS. 9 and 10, the coupling nut 140 can include a plurality of pins 149, which can be positioned around the inner circumference of the coupling nut 140. As described in greater detail herein, the pins 149 can be dimensioned and positioned to engage holes and/or apertures 159 in the annular insert 150, to prevent rotation of the annular insert 150 relative to the coupling nut 140.

Additionally or alternatively, the coupling nut 140 can include at least one axially extending alignment ridge 148, which can project radially inward from the inner surface of the coupling nut 140. Referring still to FIGS. 9 and 10, a plurality of alignment ridges 148 can extend along a portion of the length of the coupling nut 140 and can be spaced around the inner circumference of the coupling nut 140. As described in greater detail herein, the alignment ridges 148 can be dimensioned and positioned to engage alignment slots 151 defined radially inward in the annular insert 150.

Figure 11:
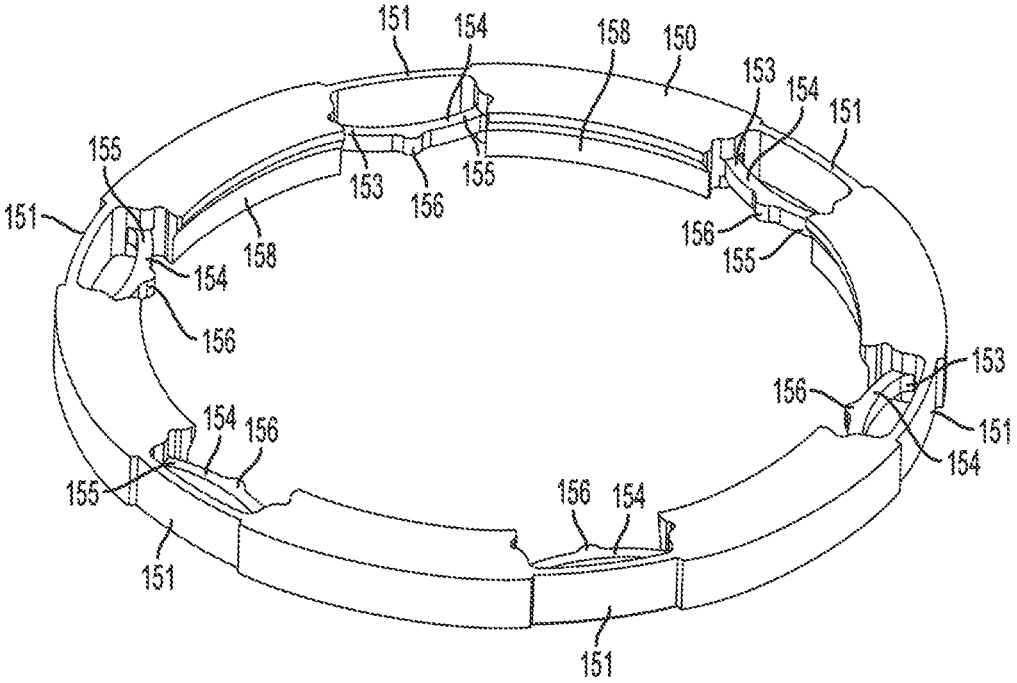
FIG. 11 is a perspective view of the annular insert of the circular connector assembly of FIG. 1, according to various embodiments of the present disclosure.
Figure 12:
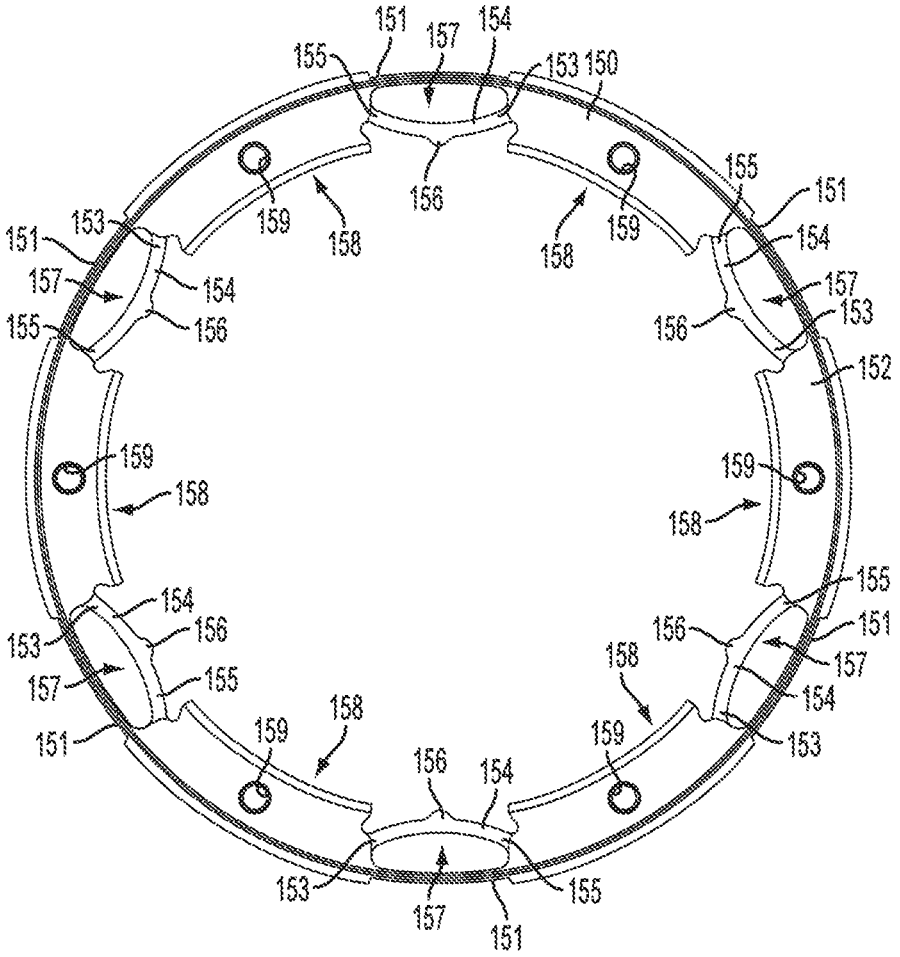
FIG. 12 is an elevation view of the annular insert of FIG. 11, according to various embodiments of the present disclosure.
Figure 13A:
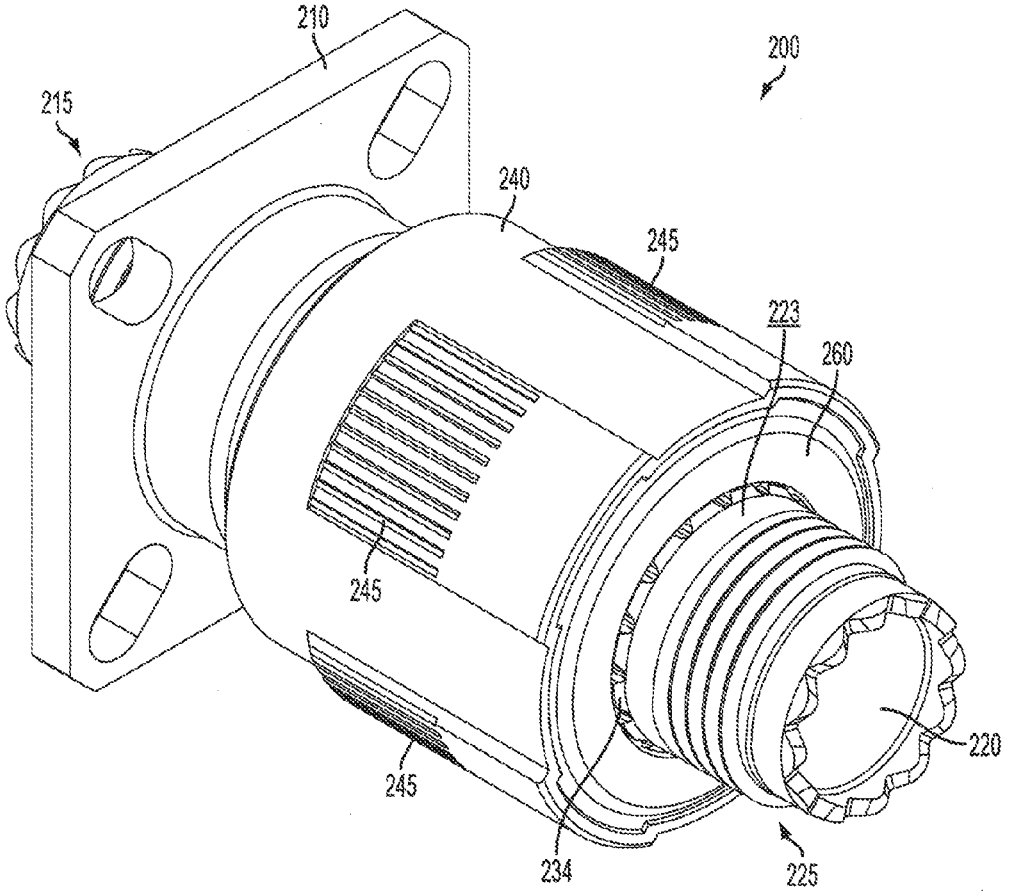
FIG. 13A is a perspective view of a circular connector assembly for electrical contacts, according to various embodiments of the present disclosure.
Figure 13B:
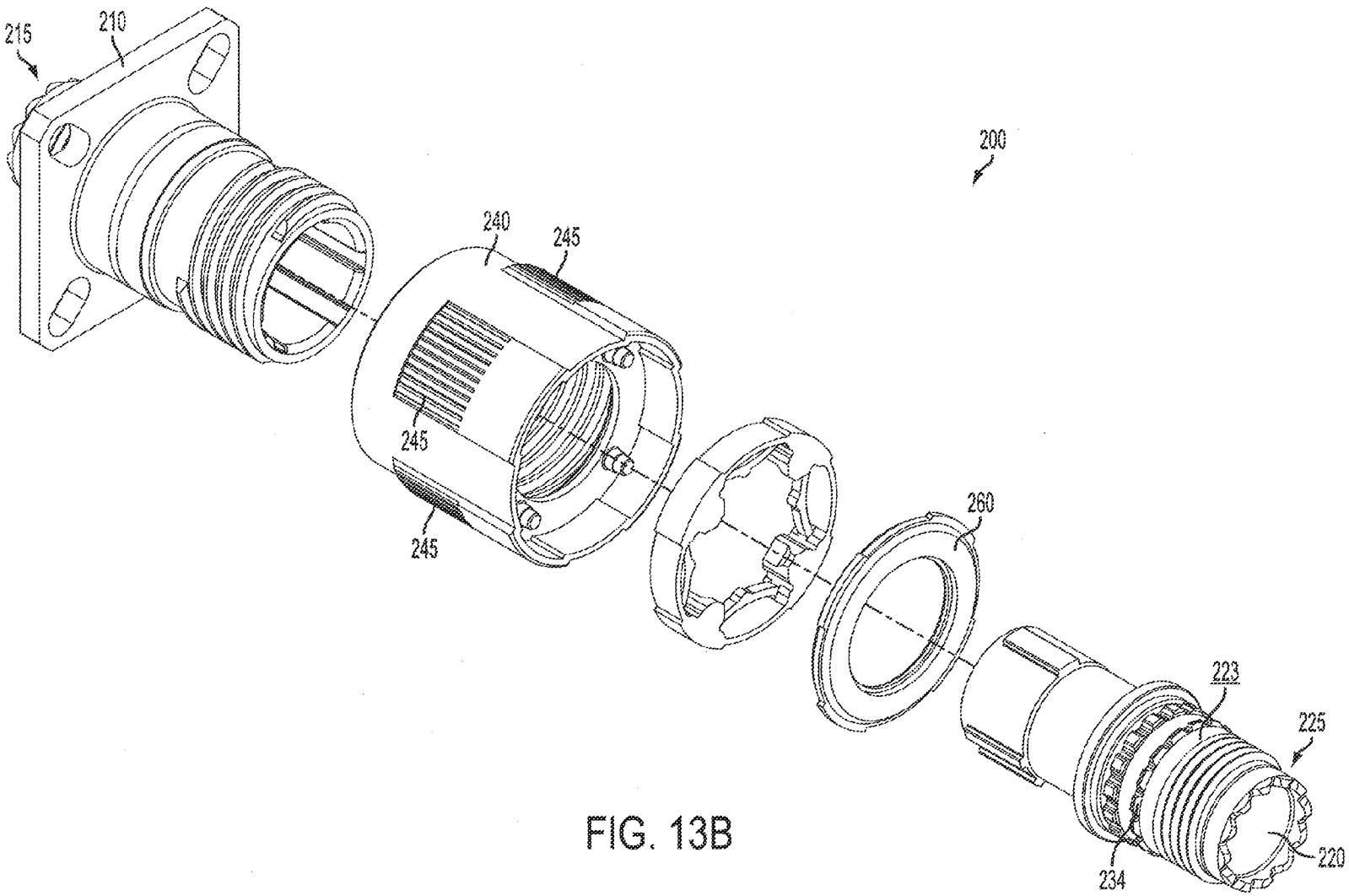
FIG. 13B is a perspective, exploded view of a circular connector assembly for electrical contacts, according to various embodiments of the present disclosure.
Figure 14:
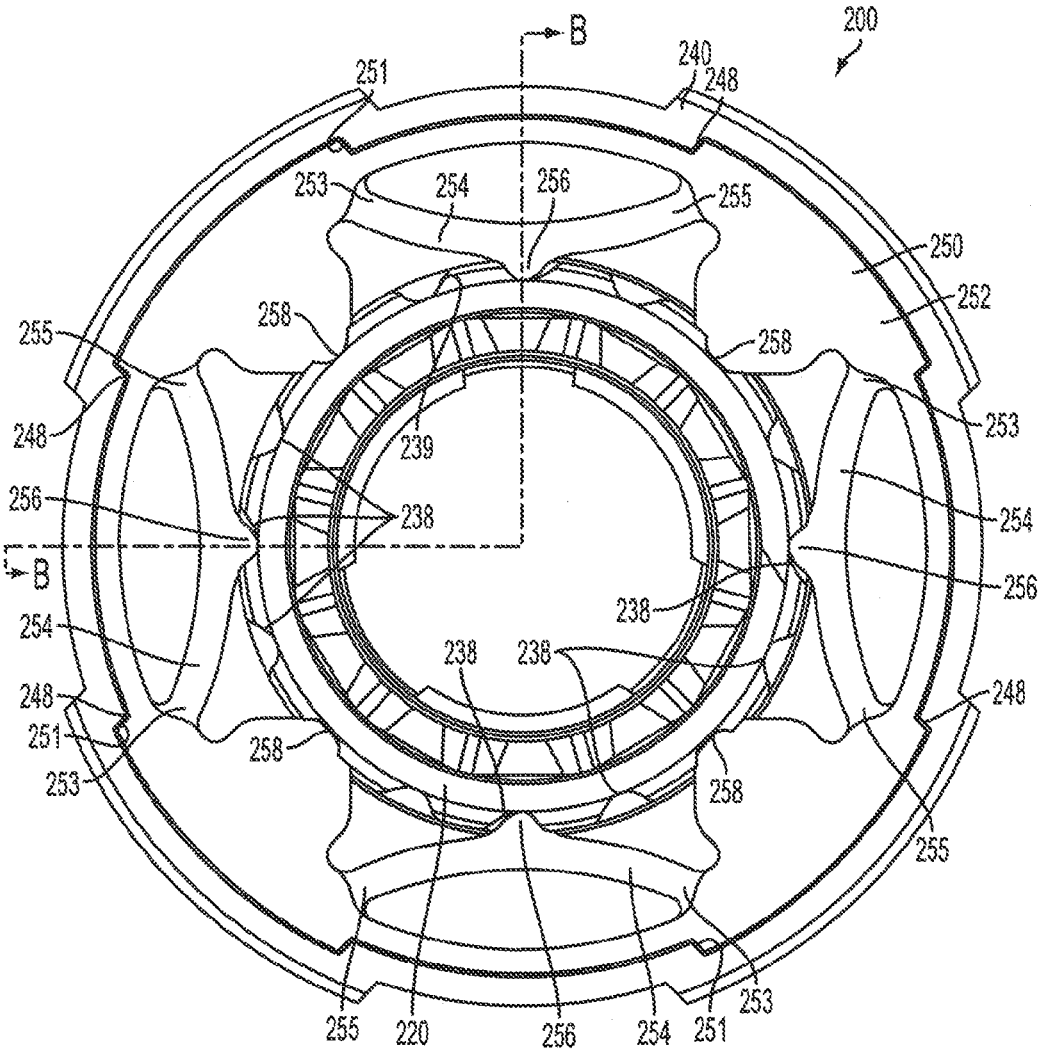
FIG. 14 is an elevation view of the circular connector assembly of FIG. 13A, depicting a coupling nut of the circular connector assembly in a first rotational orientation and further depicting spring members of an annular insert of the circular connector assembly in an unflexed orientation, according to various embodiments of the present disclosure.

Referring now to FIGS. 11 and 12, the annular insert or insert ring 150 is structured and dimensioned to fit within the coupling nut 140. The annular insert 150 can also include radially extending and/or axially extending retaining features, which can engage corresponding features on the coupling nut 140. For example, the outer perimeter of the annular insert 150 can include at least radially extending slots 151, which can securely engage a ridge 148 defined in the coupling nut 140. Additionally or alternatively, the annular insert 150 can include ridges and/or the coupling nut 140 can include corresponding grooves dimensioned and structured to receive the ridges. Moreover, referring to FIG. 12, the annular insert 150 can include apertures or holes 159, which can be dimensioned and structured to receive the pins 149, for example. Additionally or alternatively, the annular insert 150 can include pins and the coupling nut 140 can include corresponding apertures, which can be dimensioned and structured to receive the pins.

In certain instances, the annular insert 150 can be ultrasonically welded and/or fused to the coupling nut 140. In such instances, the annular insert 150 and the coupling nut 140 may also include retaining features, such as the axially extending retaining features and/or radially extending retaining features described herein. In other instances, the annular insert 150 and the coupling nut 140 may not include additional retaining features.

Referring still to FIGS. 11 and 12, the annular insert 150 can include an integrally molded body 152, which forms a unitary molded piece. The body 152 can include the axially extending and/or radially extending retaining features 148, 149, for example. Moreover, the body 152 can include at least one spring member 154. The spring member 154 can be integrally formed with the molded body 152. Referring primarily to FIG. 12, the spring member 154 can have a bowed or bow-like shape, and can bow and/or arc radially inward. For example, the spring member 154 can include a first end 153 and/or a second end 155, and can extend radially inward from the first end 153 and the second end 155.

The spring member 154 can include a tooth or catch 156 and, as depicted in FIG. 12. In various instances, a plurality of spring members 154 can be positioned around the inner perimeter of the annular insert 150 and each spring member 154 can include at least one tooth 156. For example, the annular insert 150 can include two or more integrally-formed spring members 154. Referring to the embodiment depicted in FIGS. 1-12, the annular insert 150 can include six integrally-formed spring members 154. In other instances, the annular insert 150 can include more than or less than six spring members 155. In various instances, the spring members 154 and associated teeth 156 can be equidistantly spaced around the inner perimeter of the annular insert 150.

The spring members 154 can be flexible and/or elastically deformable. For example, a space or gap 157 (see, e.g., FIG. 12) can be defined between the spring member 154 and a portion of the body 152, such that each spring member 154 can be deflected into the adjacent space 157. As described in greater detail herein, when the spring members 154 are held between the locking rib 134 and the flange 136 of the second shell 120, the spring members 154 can be aligned with the annular track 139 on the outer surface 123 of the second shell 120. Accordingly, the tooth 156 can catch and/or engage the recesses 138 in the annular track 139 to resist and/or control rotation of the annular insert 150, and thus rotation of the coupling nut 140, relative to the second shell 120, and thus, relative to the first shell 110.

Moreover, in various instances, the annular insert 150 can include at least one guide surface 158. In various instances, each guide surface 158 can be positioned intermediate spring members 154. The guide surfaces 158 can be configured to rotatably slide along the annular path 135 on the outer surface 123 of the second shell 120, as the coupling nut 140 rotates relative to the second shell 120.

Referring primarily to FIGS. 1-4, the circular connector assembly 100 can also include a protective cover 160. The protective cover 160 can conceal, cover and/or guard the annular insert 150. For example, the protective cover 160 can prevent dust and/or other debris from entering the coupling nut 140 and interfering with the spring members 154. The protective cover 160 can be snap-fit over the locking rib 134, and can be positioned between the locking rib 134 and the annular insert 150. In some instances, the protective cover 160 can include latches and/or clasps for further securing the protective cover 160 to the annular insert 150 and/or the coupling nut 140 and/or, in other instances, the coupling nut 140 can include an annular lip or protruding rim for further securing the protective cover 160 thereto.

To assemble the circular connector assembly 100, the annular insert 150 can be inserted within the coupling nut 140, and can be held in a fixed position relative to the coupling nut 140. To insert the annular insert 150 into the coupling nut 140, the alignment slots 151 of the annular insert 150 can be aligned with the alignment ridges 148 of the coupling nut 140, for example, and the apertures 159 of the annular insert 150 can be aligned with the pins 149 of the coupling nut 140. Moreover, when the alignment slots 151 are aligned with the alignment ridges 148 and the apertures 159 are aligned with the pins 149, the annular insert 150 can move axially relative to the coupling nut 140 until the annular insert 150 is fully seated within the coupling nut 140. In certain instances, the shells 110 and 120 can conform to a standard size, and a standard coupling nut can be replaced with the coupling nut 140 having the annular insert 150, for example, to circular connector assembly 100 the for high-vibration environments.

When the coupling nut 140 and the annular insert 150 are assembled, the assembly 140, 150 can be secured to the second shell 120. For example, the annular insert 150 can be snap-fit around the second shell 120. More specifically, the spring members 154 and/or guide surfaces 158 can slide over the sloped side of the locking rim 134, and may deflect to clear the locking rim 134, for example. Thereafter, the annular insert 150 can be held between the abrupt side of the locking rim 134 and the flange 136 extending from the outer surface 123 of the second shell 120. Accordingly, the coupling nut 140 and the annular insert 150 positioned therein can be locked in position around the second shell 120. In such instances, axial displacement of the coupling nut 140 relative to the second shell 120 can be limited and/or prevented.

When the coupling nut 140, the annular insert 150, and the second shell 120 are assembled, the teeth 156 of the spring members 154 can be arranged around the annular track 139 on the outer surface 123 of the second shell 120. Moreover, the teeth 156 can be rotatably aligned with the recesses 138. In other words, as the coupling nut 140 rotates relative to the second shell 120, the teeth 156 can engage and disengage the recesses 138 in the track 139. In such instances, rotation of the coupling nut 140 relative to the second shell can be permitted; however, the arrangement of the springs 154 and the recesses 138 can resist and/or control the rotation. In certain instances, the protective cover 160 can also be positioned within the coupling nut and can overlie the annular insert 150, for example.

In certain instances, the recesses 138 in the annular track 139 can include an entry side and an exit side as the coupling nut 140 rotates in a coupling direction relative to the second shell 120 to connect the second shell 120 to the first shell 110. The entry side can comprise an entry angle and the exit side can comprise an exit angle. In various instances, the entry angle can be different than the exit angle. For example, to facilitate coupling and prevent and/or resist decoupling of the first shell 110 and the second shell 120, the exit angle can be greater than the entry angle. In other words, the recesses 138 can be steeper on the recess exit side than on the recess entry side.

Additionally or alternatively, in various instances, the teeth 156 on the spring members 154 can include an entry side and an exit side as the coupling nut 140 rotates in a coupling direction relative to the second shell 120 to connect the second shell 120 to the first shell 110. The entry side can comprise an entry angle and the exit side can comprise an exit angle. In various instances, the entry angle can be different than the exit angle. For example, to facilitate coupling and prevent and/or resist decoupling of the first shell 110 and the second shell 120, the exit angle can be greater than the entry angle. In other words, the teeth 156 can be steeper on the exit side than on the entry side.

When the coupling nut 140, the annular insert 150, and the second shell 120 are assembled, the first shell 110 can be slid and/or otherwise moved into engagement with the assembly 120, 140, and 150. For example, the alignment ribs 128 of the second shell 120 can be aligned with the alignment grooves 118 of the first shell 110, and the first shell 110 can be moved toward the second shell 110 along the common axis such that the ribs 128 mate with the grooves 118 and slide therein.

Thereafter, the coupling nut 140 can be rotated to threadably engage the first shell 110. For example, the internally threaded surface 146 on the coupling nut 140 can threadably engage the externally threaded surface 116 on the first shell 110 to draw the first shell 110 toward the second shell 120. The spring members 154 can flexibly deform to permit rotation of the coupling nut 140 around the recesses 138 in the second shell 120. Moreover, the spring members 154 can engage the recesses 138 to prevent and/or resist decoupling of the first shell 110 and the second shell 120, even in high-vibration environments. Furthermore, in certain instances, the biasing sleeve 130 intermediate the first shell 110 and the second shell 120 can generate frictional resistance to decoupling of the first shell 110 and the second shell 120.

In various instances, the circular connector assembly 100 can be comprised of plastic material(s). In certain instances, the annular insert 150 can be comprised of entirely plastic material(s) and, in some instances, the annular insert 150 and the coupling nut 140 can be comprised of entirely plastic material(s). Moreover, in certain instances, at least one of the first shell 110 and the second shell 120 can be comprised of entirely plastic material(s), in addition to the annular insert 150 and the coupling nut 140 being comprised of entirely plastic material(s). In certain embodiments, the first shell 110, the second shell 120, the coupling nut 140, the annular insert 150 and the protective cover 160 can be comprised of plastic material(s). In various instances, the circular connector assembly 100 can be comprised entirely of plastic material(s). The reader will appreciate that though the circular connector assembly 100 can be comprised entirely of plastic material(s), including the first shell 110 and the second shell 120, the electrical contacts housed within the shells 110, 120 can comprise metallic and/or electrically conductive material(s).

Plastic materials for the circular connector assembly 100 can include thermoplastic materials. In certain instances, the various components of the circular connector assembly 100 can be comprised of different plastic materials and/or varying compositions of the same plastic materials, in other instances, the various components of the circular connector assembly 100 can be comprised of the same plastic materials and, in some instances, the various components of the circular connector assembly 100 can be comprised of the same compositions of the same plastic materials, for example.

Another exemplary embodiment of a circular connector assembly 200 and various components thereof are depicted in FIGS. 13A-20. The circular connector assembly 200 can be similar in several ways to the circular connector assembly 100 and like reference characters can refer to similar components. The reader will further appreciate that various features illustrated and/or described with respect to circular connector assembly 200 can be combined with the features of other embodiments.

The circular connector assembly 200 can include a first shell 210 that houses at least one electrical contact, a second shell 220 that houses at least one corresponding electrical contact, and a coupling nut 240 that is configured to secure the first shell 210 and the second shell 220 together to physically connect and electrically couple the electrical contacts therein. When the first shell 210 and the second shell 220 are assembled together, rotation of the first shell 210 relative to the second shell 220 can be limited and/or prevented. For example, the first shell 210 and the second shell 220 can include alignment features, which prevent rotation of the first shell 210 relative to the second shell 220. It may be desirable to prevent rotation of the first shell 210 relative to the second shell 220 to maintain alignment of the electrical contacts housed therein and to prevent damage thereto.

An annular insert 250 can be inserted into the coupling nut 240, and can be held in a fixed positioned relative to the coupling nut 240. Accordingly, the coupling nut 240 can include a plurality of retaining features, which can engage corresponding retaining features on the annular insert 250. In various instances, the coupling nut 240 can include axially extending retaining features and/or radially extending retaining features. For example, the coupling nut 240 can include at least one axially extending pin 249. In certain instances, the coupling nut 240 can include a plurality of pins 249, which can be positioned around an inner circumference of the coupling nut 240. Moreover, the annular insert 250 can include at least one axially extending aperture 259. In certain instances, the annular insert 250 can include a plurality of apertures 259, and the pins 249 can be dimensioned and positioned to engage holes and/or apertures 259 in the annular insert 250.

Additionally or alternatively, the coupling nut 240 can include at least one axially extending alignment ridge 248, which can project radially inward from the inner surface of the coupling nut 240. In certain instances, a plurality of alignment ridges 248 can extend along a portion of the length of the coupling nut 240 and can be spaced around the inner circumference of the coupling nut 240. As described in greater detail herein, the alignment ridges 148 can be dimensioned and positioned to engage alignment slots 251 defined radially inward in the annular insert 250.

The annular insert or insert ring 250 can be structured and dimensioned to fit within the coupling nut 240. Moreover, the annular insert 250 can also include radially extending and/or axially extending retaining features, which can engage corresponding features on the coupling nut 240. For example, the outer perimeter of the annular insert 120 can include at least retaining slot 251, which can securely engage one of the retaining ridges 248 defined in the coupling nut 240. Additionally or alternatively, the annular insert 250 can include alignment ridges and/or the coupling nut 240 can include corresponding alignment slots dimensioned and structured to receive the alignment ridges. Moreover, the annular insert 250 can include apertures or holes 259, which can be dimensioned and structured to receive the pins 249, for example. Additionally or alternatively, the annular insert 250 can include pins and the coupling nut 240 can include corresponding apertures, which can be dimensioned and structured to receive the pins, for example.

In certain instances, the annular insert 250 can be ultrasonically welded to the coupling nut 240. In such instances, the annular insert 250 and the coupling nut 240 may also include retaining features, such as the axially extending retaining features and/or radially extending retaining features described herein. In other instances, the annular insert 250 and the coupling nut 240 may not include additional retaining features.

The annular insert 250 can include an integrally molded body 252, which can form a unitary molded piece. In various instances, the body 252 can include the axially extending and/or radially extending retaining features 248, 249, for example. Moreover, the body 252 can include at least one flexible spring member 254, which can be integrally formed with the molded body 252. The spring member 254 can have a bowed or bow-like shape, and can bow and/or arc radially inward. For example, the spring member 254 can include a first end 253 and/or a second end 255, and can extend radially inward between the first end 253 and the second end 255, for example.

The spring member 254 can further include a tooth or catch 256, which can be configured to rotatably engage the recesses 238 along the annular track 239 on the outer surface 223 of the second shell 220 as the coupling nut 240 rotates relative to the second shell 220. In various instances, a plurality of spring members 254 can be positioned around the inner perimeter of the annular insert 250 and each spring member 254 can include at least one tooth 256. Referring to the embodiment depicted in FIGS. 13A-20, the annular insert 250 can include four integrally-formed spring members 254 and, in various instances, the four spring members 254 and associated teeth 256 can be spaced equidistantly around the inner perimeter of the annular insert 250.

Figure 20:
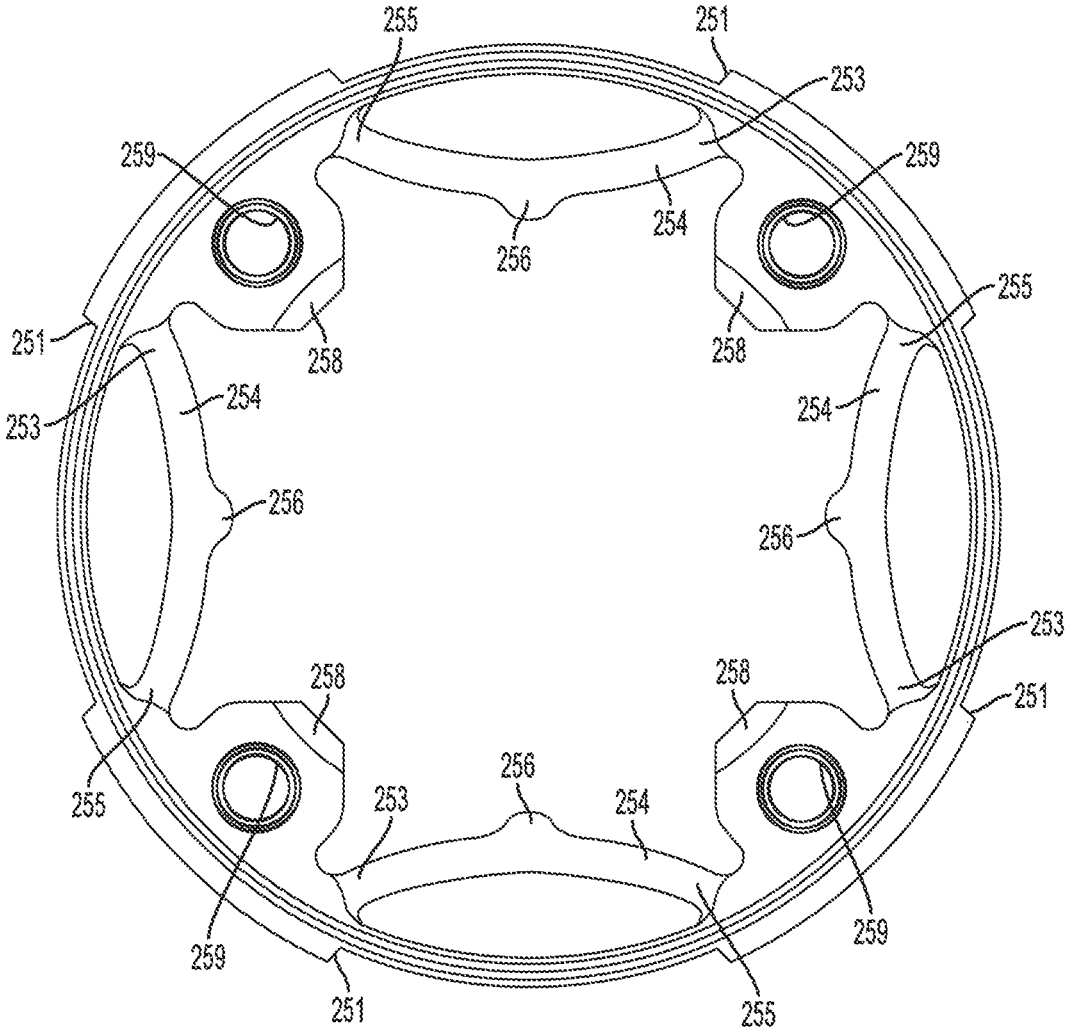
FIG. 20 is an elevation view of the annular insert of FIG. 19, according to various embodiments of the present disclosure.

Moreover, in various instances, the annular insert 250 can include at least one guide surface 258. In various instances, each guide surface 258 can be positioned intermediate adjacent spring members 254. The guide surfaces 258 can be configured to rotatably slide along a portion of the outer surface 223 that is intermediate the locking rib 234 and the flange 236, as the coupling nut 240 rotates relative to the second shell 220. The guide surfaces 258 can project radially inward from the body 252 of the annular insert 250. Referring primarily to FIG. 20, the guide surfaces 238 can be positioned radially inward of the teeth 256. In such instances, the body 252 can define a contour and/or cutout, which can be longitudinally aligned with the track 239, and the guide surfaces 258 can be longitudinally offset from the track 239, for example. In such an arrangement, interference between the guide surfaces 258 and the track 239 of recesses 238 can be avoided.

The circular connector assembly 200 can also include a protective cover 260 (FIGS. 13A, 13B, and 14), which can conceal, cover and/or guard the annular insert 250. The protective cover 260 can be snap-fit over the locking rib 234, and can be positioned between the locking rib 234 and the annular insert 250. In some instances, the protective cover 260 can include latches and/or clasps for further securing the protective cover 260 to the annular insert 250 and/or to the coupling nut 240 and/or, in some instances, the coupling nut 240 can include an annular lip or protruding rim for further securing the protective cover 260 thereto.

Assembly of the circular connector assembly 200 can be similar to the assembly of the circular connector assembly 100. When assembled, the coupling nut 240 and the annular insert 250 can be axially restrained around the second shell 220; however, the coupling nut 240 and the annular insert 250 can be configured to rotate relative to the second shell 220. For example, the annular insert 250 can be snap-fit or otherwise secured between the locking flange 234 and the locking rib 236 (see, e.g., FIG. 14), which can protrude from the outer surface 223 of the second shell 220. Additionally, the flexible spring members 254 can engage the annular track 239 of recesses 238 defined in the outer surface 223 of the second shell 220.

Figure 15:
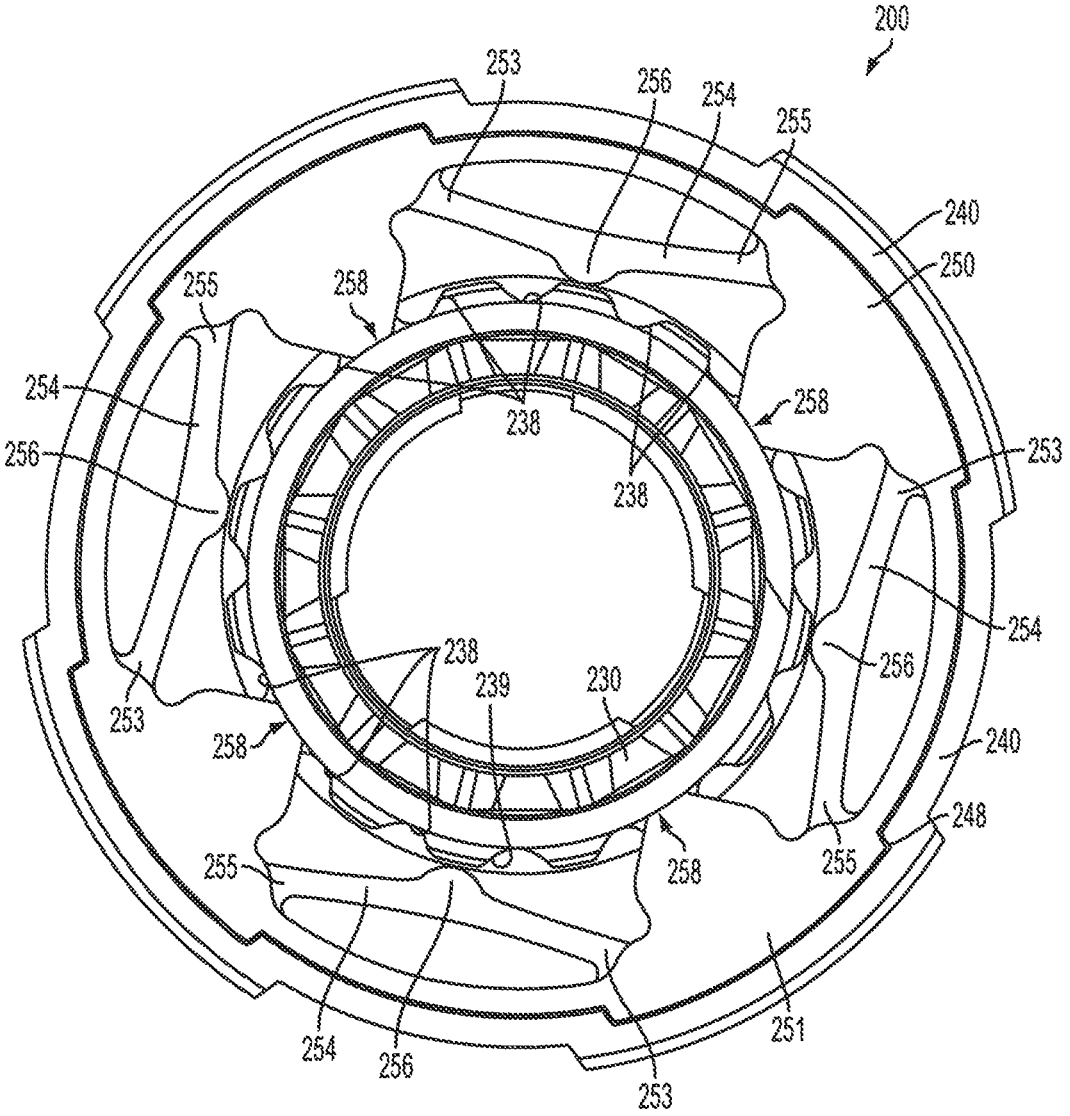
FIG. 15 is an elevation view of the circular connector assembly of FIG. 13A, depicting the coupling nut in a second rotational orientation and further depicting the spring members of the annular insert in a flexed orientation, according to various embodiments of the present disclosure.
Figure 16:
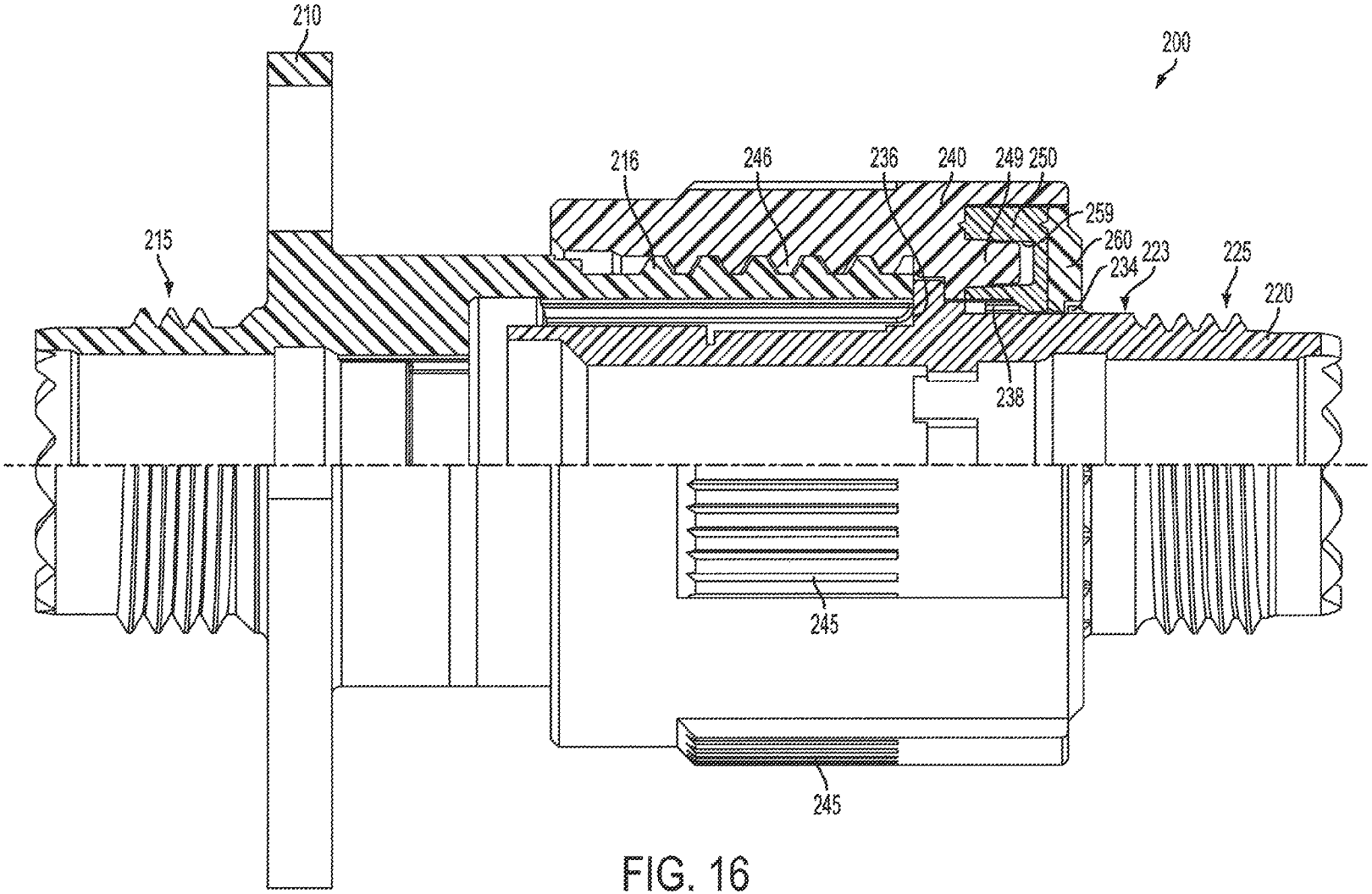
FIG. 16 is a quarter cross-sectional, elevation view of the circular connector assembly of FIG. 13A taken along the section lines B-B depicted in FIG. 14, according to various embodiments of the present disclosure.
Figure 17:
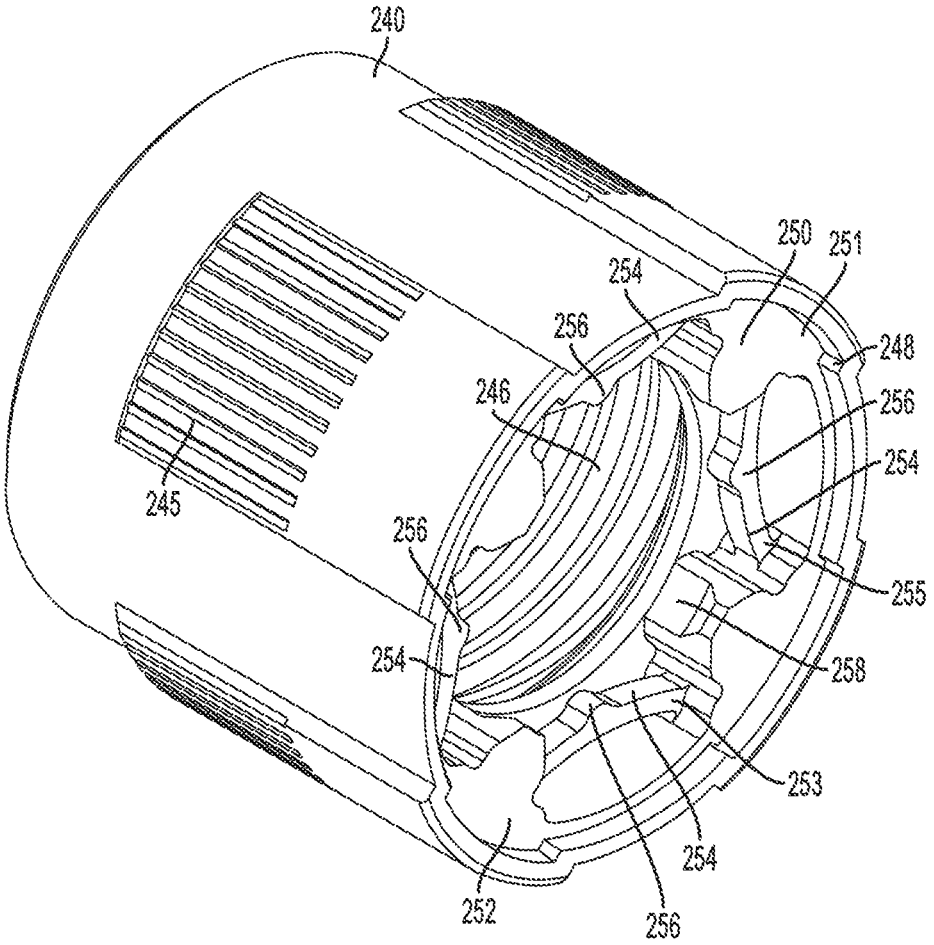
FIG. 17 is a perspective view of the coupling nut and the annular insert of the circular connector of FIG. 13A, according to various embodiments of the present disclosure.
Figure 18:
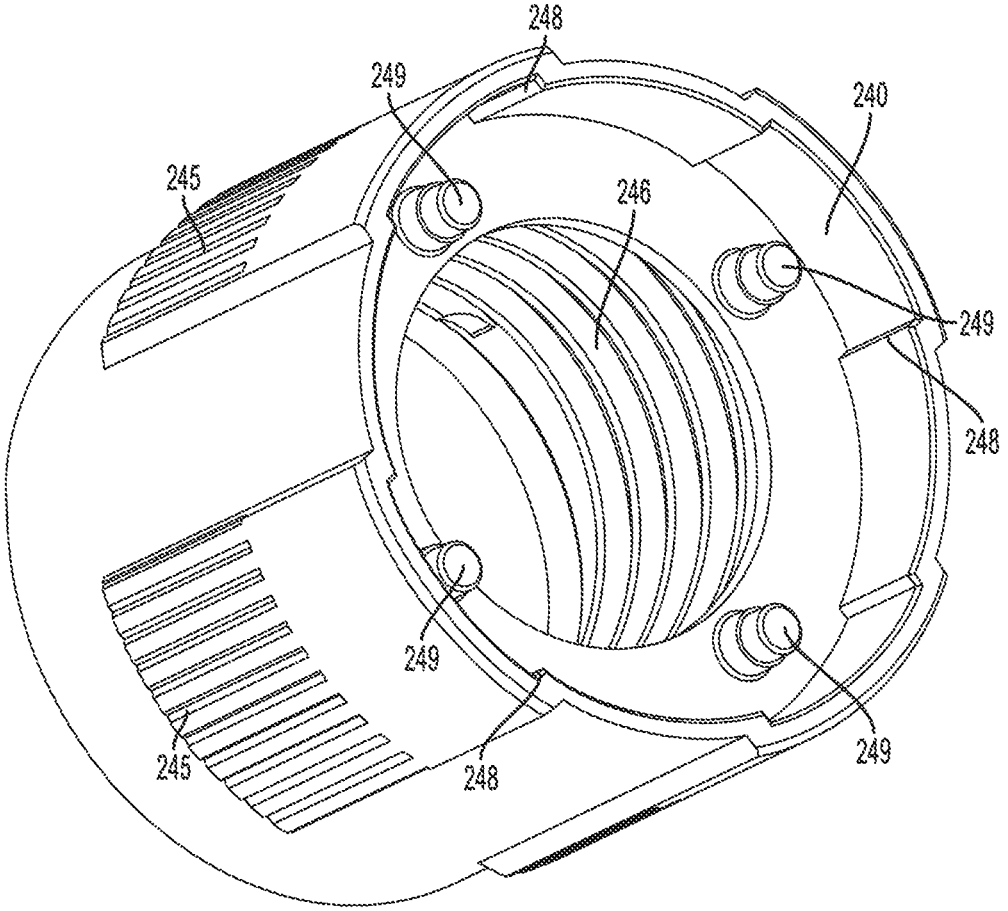
FIG. 18 is a perspective view of the coupling nut of FIG. 17, according to various embodiments of the present disclosure.
Figure 19:
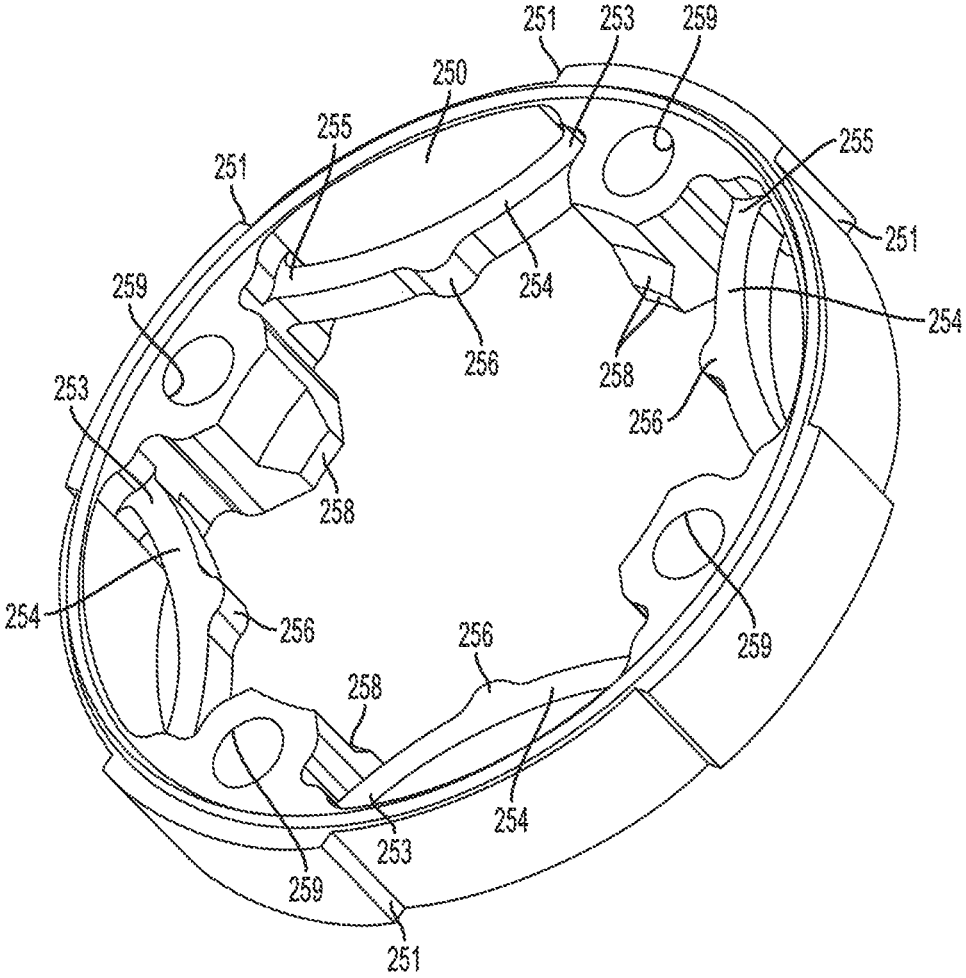
FIG. 19 is a perspective view of the annular insert of FIG. 17, according to various embodiments of the present disclosure.

As the coupling nut 240 rotates relative to the second shell 220, the spring-loaded teeth 256 of the annular insert 250 can releasably engage the recesses 238 in the second shell 220. For example, as depicted in FIG. 16, the flexible spring members 254 can flex and/or deflect into the space defined in the annular insert 250 as the coupling nut 240 rotates. As the coupling nut 240 continues to rotate and the teeth 256 are again aligned with the recesses 238, as depicted in FIG. 15, the flexible spring members 254 can rebound such that the teeth 256 extend into the recesses 238. The geometry of the recesses 238 can permit rotation of the annular insert 250 relative to the second shell 220; however, such rotation can be controlled and/or restrained. For example, in certain embodiments, rotation in a decoupling direction can be resisted more than rotation in a coupling direction.

In various instances, as the coupling nut 240 and the annular insert 250 therein rotate in a coupling direction relative to the second shell 220, the threaded portion 246 of the coupling nut 240 can be configured to threadably engage a threaded portion on the first shell 210 to draw the first shell 210 toward the second shell 220. Moreover, rotation of the coupling nut 240 and the annular insert 250 in the decoupling direction can be resisted by the engagement of the spring members 254 with the recesses 238 defined in the outer surface 223 of the second shell 223. The shells 210 and 220, the annular insert 250, and the coupling nut 240 can be comprised of a plastic material such that metal-to-plastic contacts between the rotating components is avoided. For example, the annular insert 250 can consist of a unitary molded piece, and the spring members 254 can be integrally formed parts of the unitary molded piece.

Another exemplary embodiment of a circular connector assembly 300 and various components thereof are depicted in FIGS. 21-27A. The circular connector assembly 300 can be similar in several ways to the circular connector assemblies 100 and 200, and like reference characters can refer to similar components. The reader will further appreciate that various features illustrated and/or described with respect to circular connector assembly 300 can be combined with the features of other embodiments.

The circular connector assembly 300 can include a first shell, such as shell 110 (FIGS. 1-7) or shell 210 (FIGS. 13A, 13B and 14), for example, that houses at least one electrical contact, a second shell 320 that houses at least one corresponding electrical contact 308 (FIGS. 22-27), and a coupling nut 340 that is configured to secure the first shell and the second shell 320 together to physically connect and electrically couple the electrical contacts therein. When the first shell and the second shell 320 are assembled together, rotation of the first shell relative to the second shell 320 can be limited and/or prevented. For example, the first shell and the second shell 320 can include alignment features, which can prevent rotation of the first shell relative to the second shell 320. It may be desirable to prevent rotation of the first shell relative to the second shell 320 to maintain alignment of the electrical contacts housed therein and to prevent damage thereto, for example.

Figure 21:
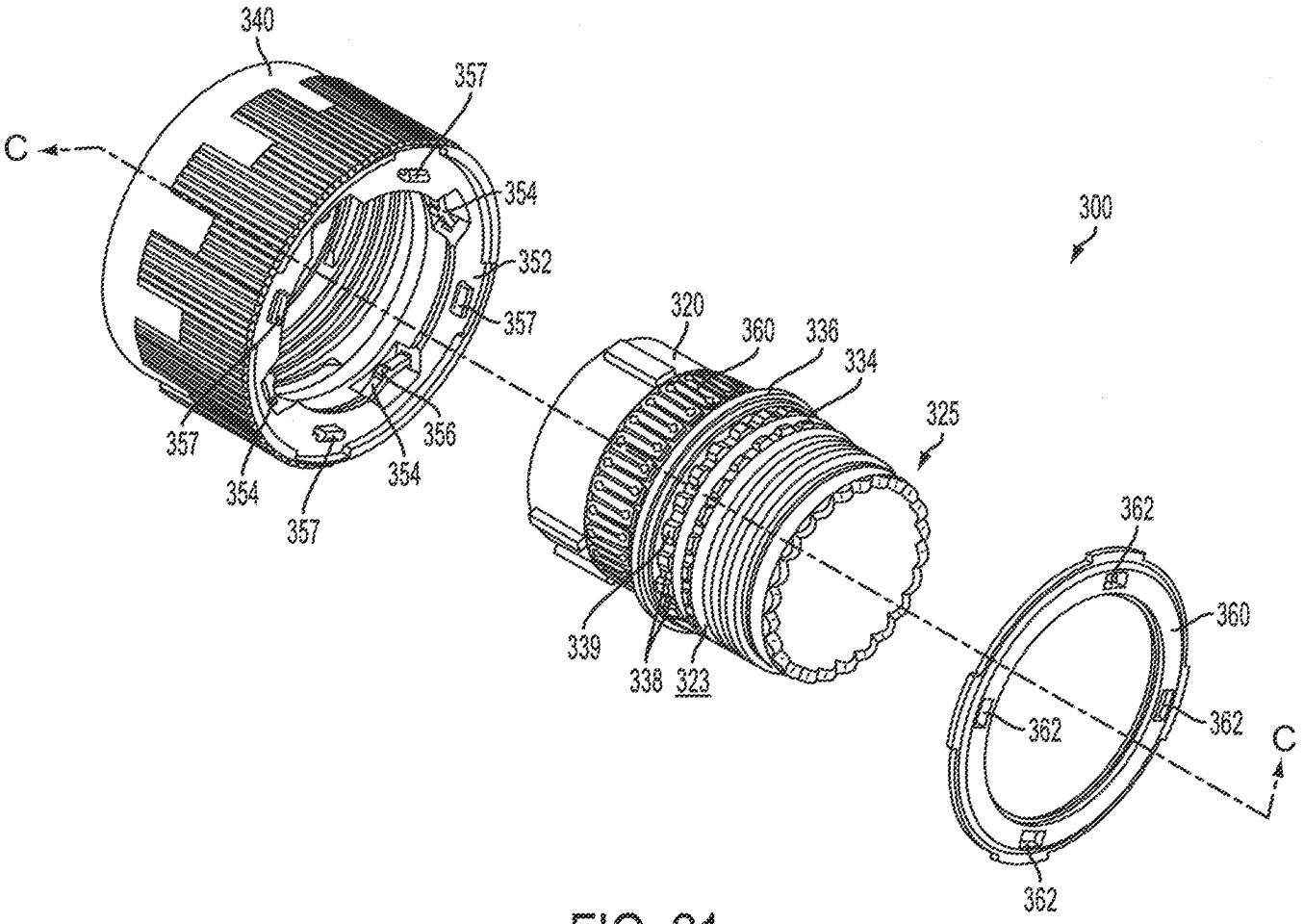
FIG. 21 is a perspective, exploded view of a circular connector comprising a shell, a coupling nut, and a protective cover, according to various embodiments of the present disclosure.

Referring primarily to FIG. 21, the coupling nut 340 can include at least one integral spring member 354. More specifically, the coupling nut 340 can include an integrally molded body 352, which can form a unitary molded piece. In various instances, the body 352 can include at least one flexible spring member 354, which can be integrally formed with the molded body 352. In other instances, the spring members 354 and/or an insert that includes the spring members 354 may have been inserted into the coupling nut and ultrasonically welded and/or fused to the coupling nut 340. The circular connector assembly 300 can be retrofit with the coupling nut 340 for application in high vibration environments. For example, a standard coupling nut can be replaced with the coupling nut 340, which can include integrally formed spring members 354 to resist rotation in the decoupling direction. The coupling nut 340 can be produced in a standard size, such that it fits around a standard sized shell, for example.

Referring still to FIG. 21, the spring member 354 can have a bowed or bow-like shape, and can bow and/or arc radially inward. The spring member 354 can further include a tooth or catch 356, which can be configured to rotatably engage recesses 338 along an annular track 339 on an outer surface 323 of the second shell 320 as the coupling nut 340 rotates relative to the second shell 320. In various instances, the coupling nut 340 can include a plurality of spring members 354 and each spring member 354 can include at least one tooth 356. Referring to the embodiment depicted in FIGS. 21-27, the coupling nut 340 can include four integrally-formed spring members 354 and, in various instances, the four spring members 354 and associated teeth 356 can be spaced equidistantly around the inner perimeter of the coupling nut 340. In other instances, the coupling nut 340 can include more than or less than four spring members. The coupling nut 340 can also include at least one guide surface, which can be configured to rotatably slide along a portion of the outer surface 323 that is intermediate a locking rib 334 and a flange 336 of the second shell 320, as the coupling nut 340 rotates relative to the second shell 320.

The coupling nut 340 can also include a locking shoulder 372 (FIGS. 22-27A). The locking shoulder 372 can protrude radially inward and form a projecting lip around the inner perimeter of the coupling nut 340. In various instances, the locking shoulder 372 can define the innermost surface of the coupling nut 340. The locking shoulder 372 can also include a shoulder stop 374, which can comprise a stepped and/or abruptly angled surface facing the threaded portion 346 of the coupling nut 340.

The circular connector assembly 300 can also include a protective cover 360, which can conceal, cover and/or guard the interior of the coupling nut 340 and/or the spring members 354, for example. The protective cover 360 can be snap-fit over the locking rib 334, and can be positioned against the coupling nut 340. In some instances, the protective cover 360 and/or the coupling nut 340 can include at least one latch and/or clasp for further securing the protective cover 360 to the coupling nut 340. For example, the coupling nut 340 can include a plurality of latches 357, which can extend axially from the coupling nut 340 and can be configured to engage the cover 360. More specifically, the cover 360 can include apertures 362, which can be dimensioned and structured to receive the latches 357. The latches 357 can be flexible, for example, and may elastically deflect to enter the apertures 362 and engage the cover 360.

Additionally or alternatively, the coupling nut 340 can include an annular lip or protruding rim for securing the protective cover 360 thereto.

Figure 22:
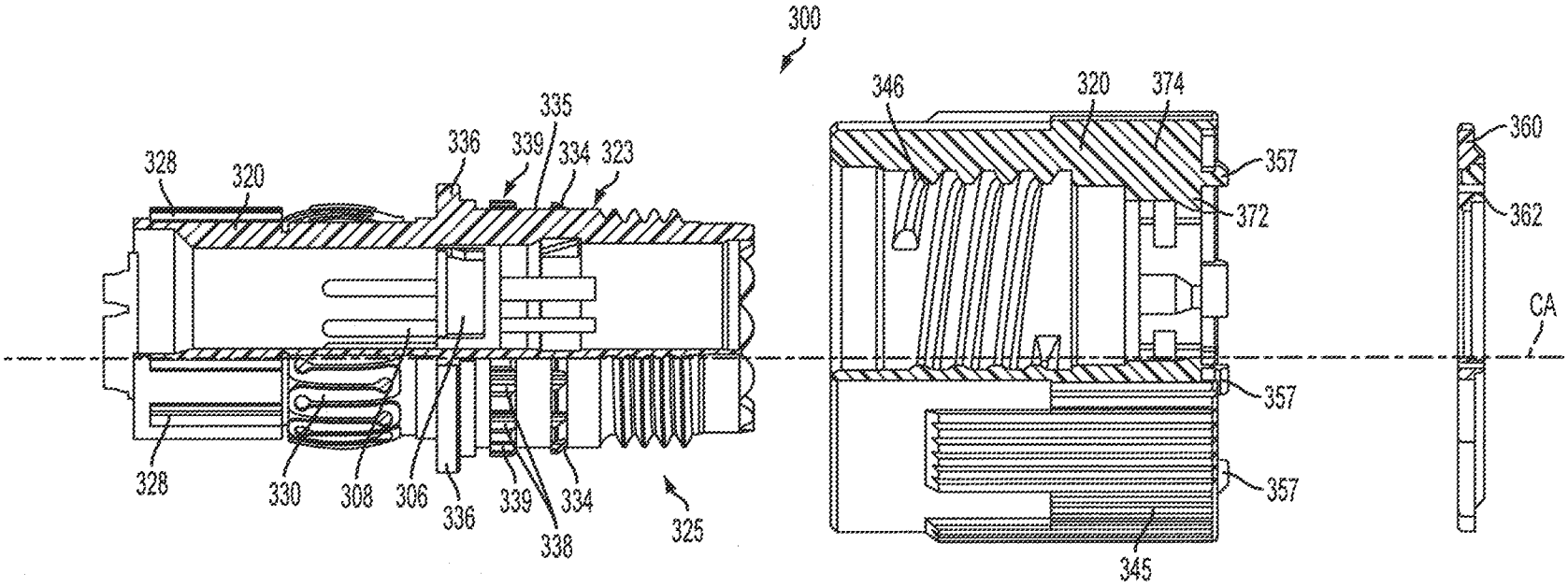
FIG. 22 is a quarter cross-sectional, elevation view of the circular connector of FIG. 21 taken along the section lines C-C in FIG. 21, depicting the coupling nut in a partially assembled position and the protective cover in an unassembled position, according to various embodiments of the present disclosure.
Figure 23:
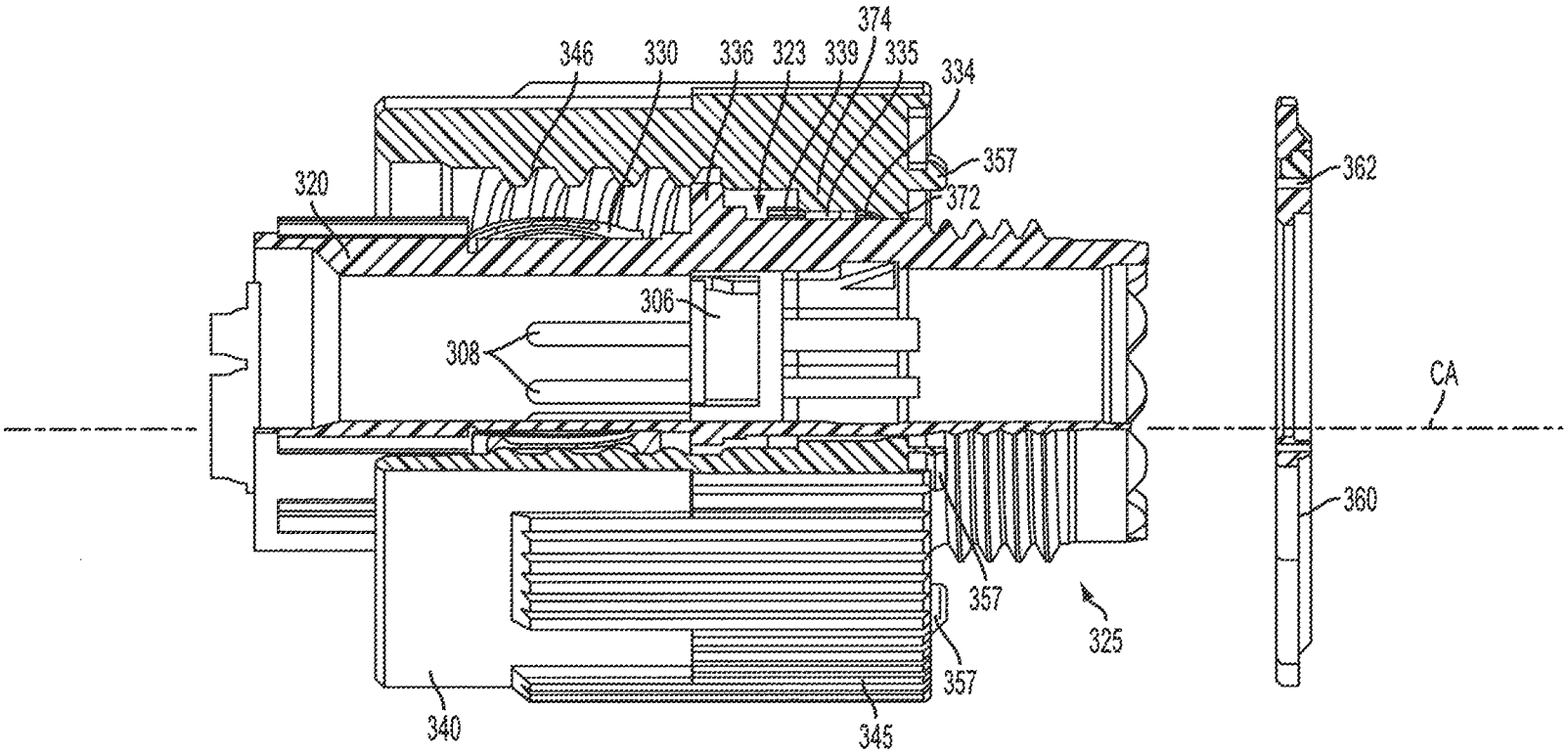
FIG. 23 is a quarter cross-sectional, elevation view of the circular connector of FIG. 21 taken along the section lines C-C in FIG. 21, depicting the coupling nut in another partially assembled position and the protective cover in the unassembled position, according to various embodiments of the present disclosure.
Figure 24:
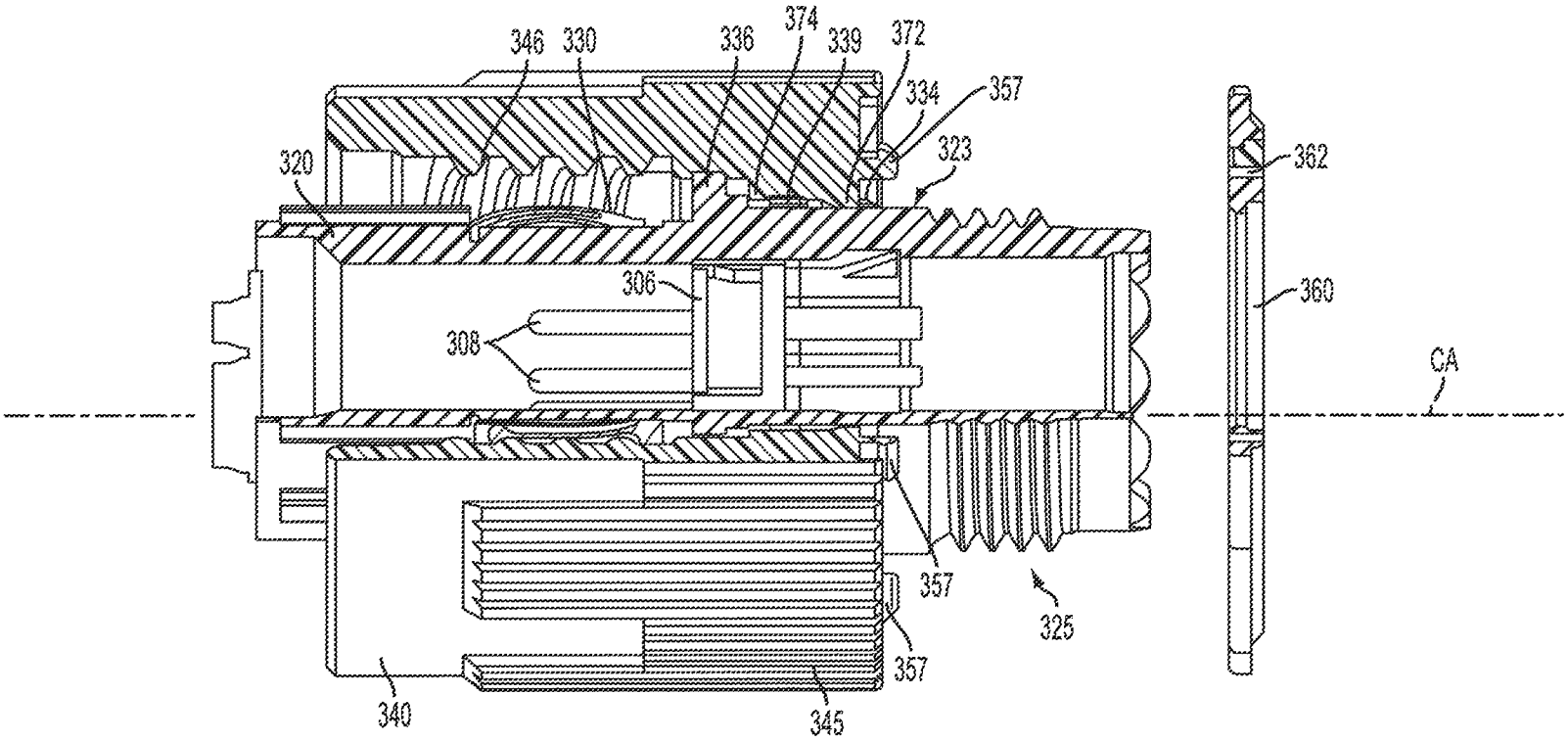
FIG. 24 is a quarter cross-sectional, elevation view of the circular connector of FIG. 21 taken along the section lines C-C in FIG. 21, depicting the coupling nut in another partially assembled position and the protective cover in the unassembled position, according to various embodiments of the present disclosure.
Figure 25:
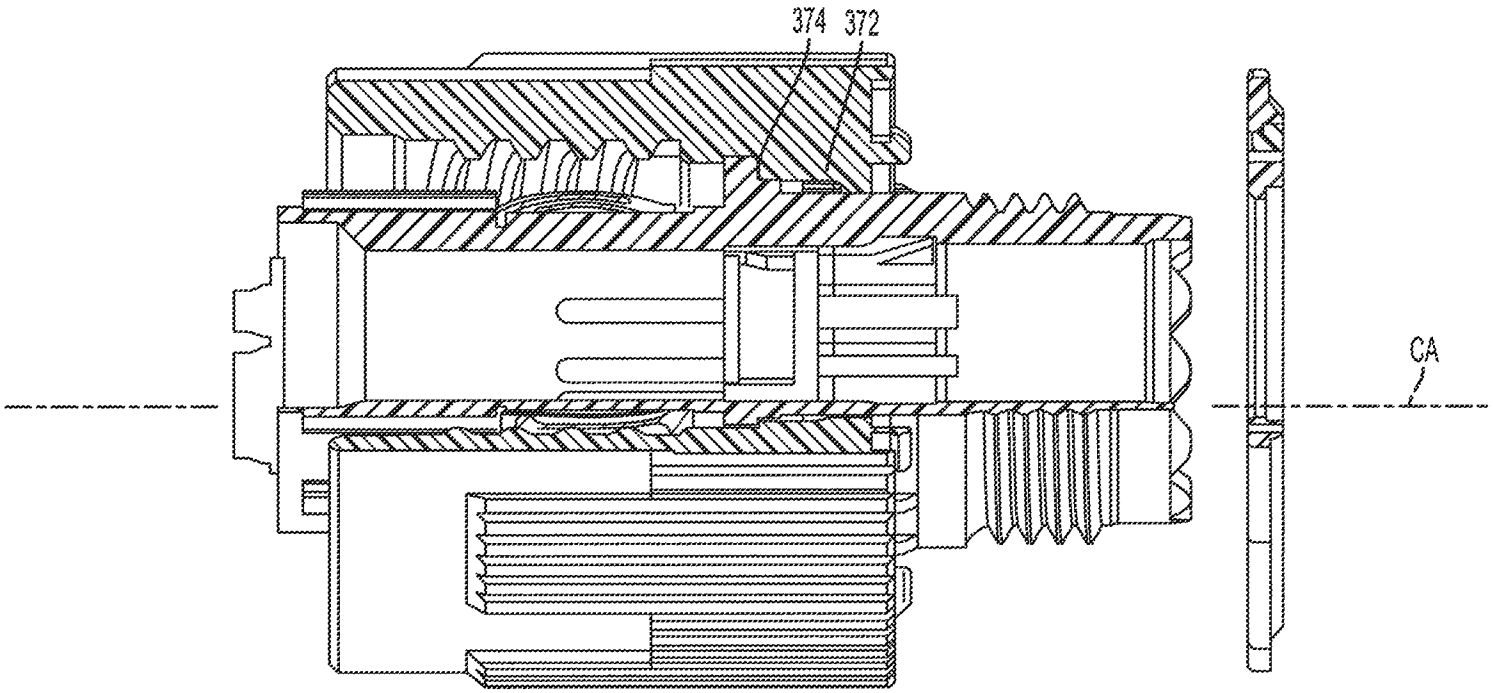
FIG. 25 is a quarter cross-sectional, elevation view of the circular connector of FIG. 21 taken along the section lines C-C in FIG. 21, depicting the coupling nut in an assembled position and the protective cover in the unassembled position, according to various embodiments of the present disclosure.
Figure 26:
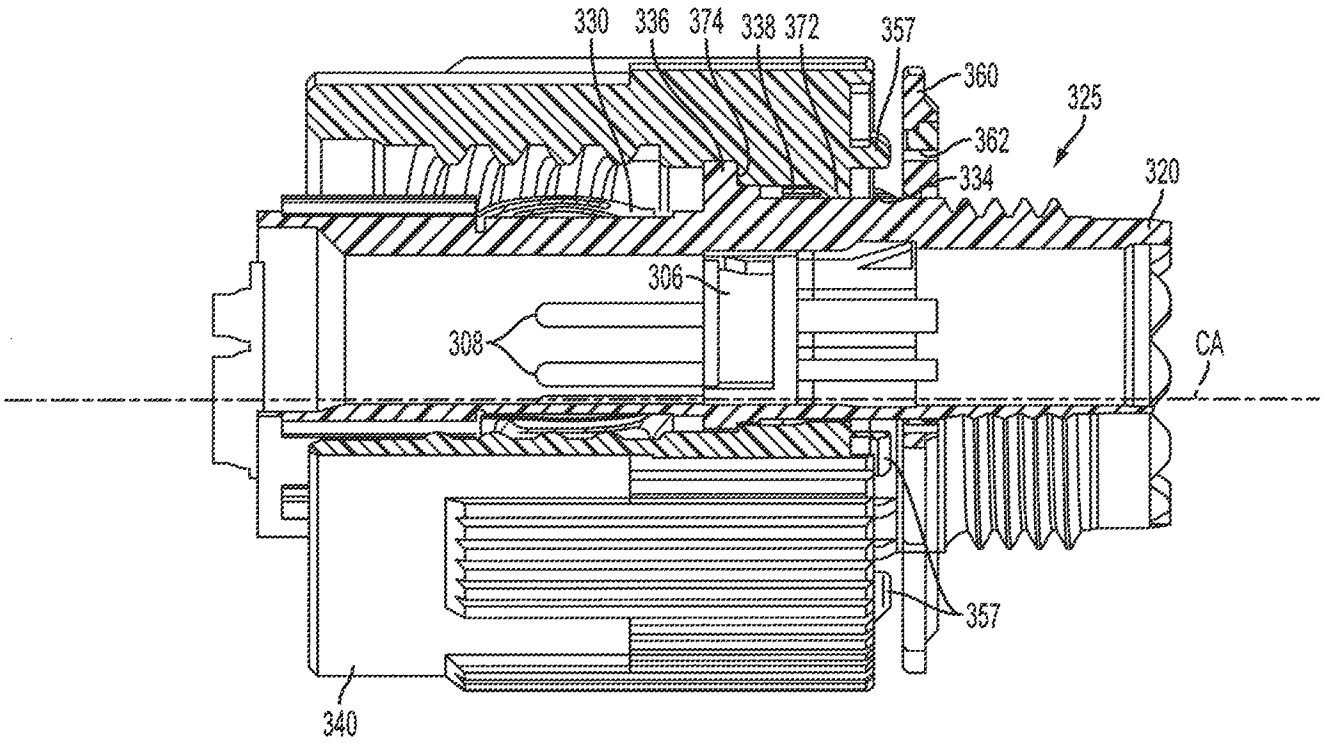
FIG. 26 is a quarter cross-sectional, elevation view of the circular connector of FIG. 21 taken along the section lines C-C in FIG. 21, depicting the coupling nut in the assembled position and the protective cover in a partially unassembled position, according to various embodiments of the present disclosure.
Figure 27:
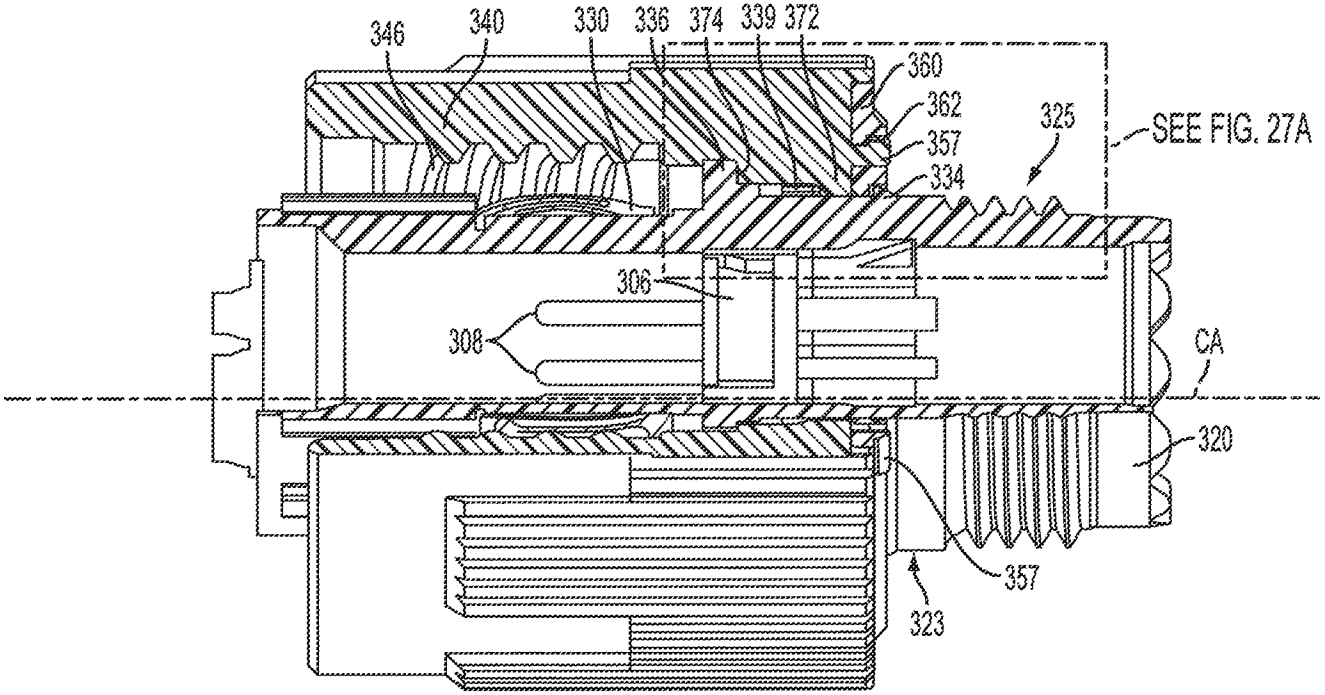
FIG. 27 is a quarter cross-sectional, elevation view of the circular connector of FIG. 21 taken along the section lines C-C in FIG. 21, depicting the coupling nut in the assembled position and the protective cover in an assembled position, according to various embodiments of the present disclosure.
Figure 27A:
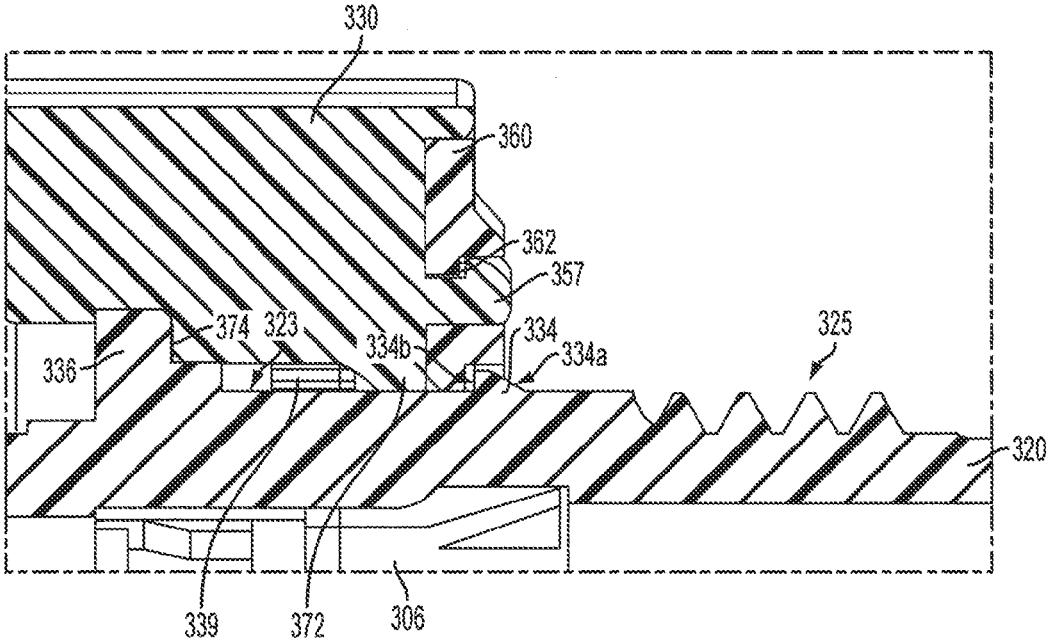
FIG. 27A is a detail view of the region depicted in FIG. 27, according to various embodiments of the present disclosure.

The assembly of the circular connector assembly 300 is partially depicted in FIGS. 22-27A. Referring to FIG. 22, the shell 320, the coupling nut 340 and/or the cover 360 can be arranged along the common axis CA, which can extend along the central axis of the shell 320, the coupling nut 340 and the cover 360, for example. Referring to FIG. 23, the coupling nut 340 can move relative to the shell 320 along the axis CA. The locking shoulder 372 of the coupling nut 340 can move into abutting engagement with the locking rib 334 on the second shell 320. The locking rib 334 can include a sloped profile 334*a* (FIG. 27A) and an abrupt and/or less-sloped profile 334*b* (FIG. 27A). As depicted in FIG. 23, the locking shoulder 372 can first contact the sloped profile 334*a* of the locking rib 334. Referring now to FIG. 24, a locking shoulder 372 of the coupling nut 340 can be snap-fit over the sloped profile 334*a* of the locking rib 334, and can be positioned between the abrupt profile 334*b* of the locking rib 334 and the flange 336.

As the coupling nut 340 continues to move relative to the shell 320 along the axis CA, referring to FIG. 25, the shoulder stop 374 of the locking shoulder 372 can move into abutting engagement with the flange 336 that protrudes from the outer surface 323 of the second shell 330. When the shoulder stop 374 abuts the flange 336, the coupling nut 340 can be fully seated relative to the shell 320. Thereafter, as depicted in FIG. 26, the protective cover 360 can move along the axis CA relative to the coupling nut 340 and the second shell 320 assembly. As the protective cover 360 approaches the coupling nut 340, the apertures 362 in the cover 360 can be axially aligned with the latches 357 extending from the coupling nut 340. Referring to FIGS. 27 and 27A, the latches 357 can extend through the apertures 362 when the cover 360 is fully seated within the coupling nut 340. The fully seated cover 360 can be positioned intermediate the locking rib 374 and the flange 376, and can further bias the locking shoulder 374 of the coupling nut 340 against the flange 336, for example.

When assembled, the coupling nut 340 can be axially restrained around the second shell 320; however, the coupling nut 340 can be configured to rotate relative to the second shell 320. For example, the coupling nut 340 can be snap-fit or otherwise secured between the locking flange 334 and the locking rib 336, as described above. Additionally, the flexible spring members 354 (FIG. 21) can engage the annular track 339 of recesses 338 (FIG. 21) defined in the outer surface 323 of the second shell 320. The geometry of the recesses 238 can permit rotation of the coupling nut 340 relative to the second shell 320; however, such rotation can be controlled and/or restrained. For example, in certain embodiments, rotation in a decoupling direction can be resisted more than rotation in a coupling direction.

In various instances, as the coupling nut 340 rotates in a coupling direction relative to the second shell 320, the threaded portion 346 of the coupling nut 340 can be configured to threadably engage a threaded portion on the first shell to draw the first shell toward the second shell. Moreover, rotation of the coupling nut 340 in the decoupling direction can be resisted by the engagement of the spring members 354 with the recesses 338 defined in the outer surface 323 of the second shell 323. The first shell, the second shell 320, and the coupling nut 340 can be comprised of a plastic material such that metal-to-plastic contacts between the rotating components is avoided. For example, the coupling nut 340 can consist of a unitary molded piece, and the spring members 354 can be integrally formed parts of the unitary molded piece.

Figure 28:
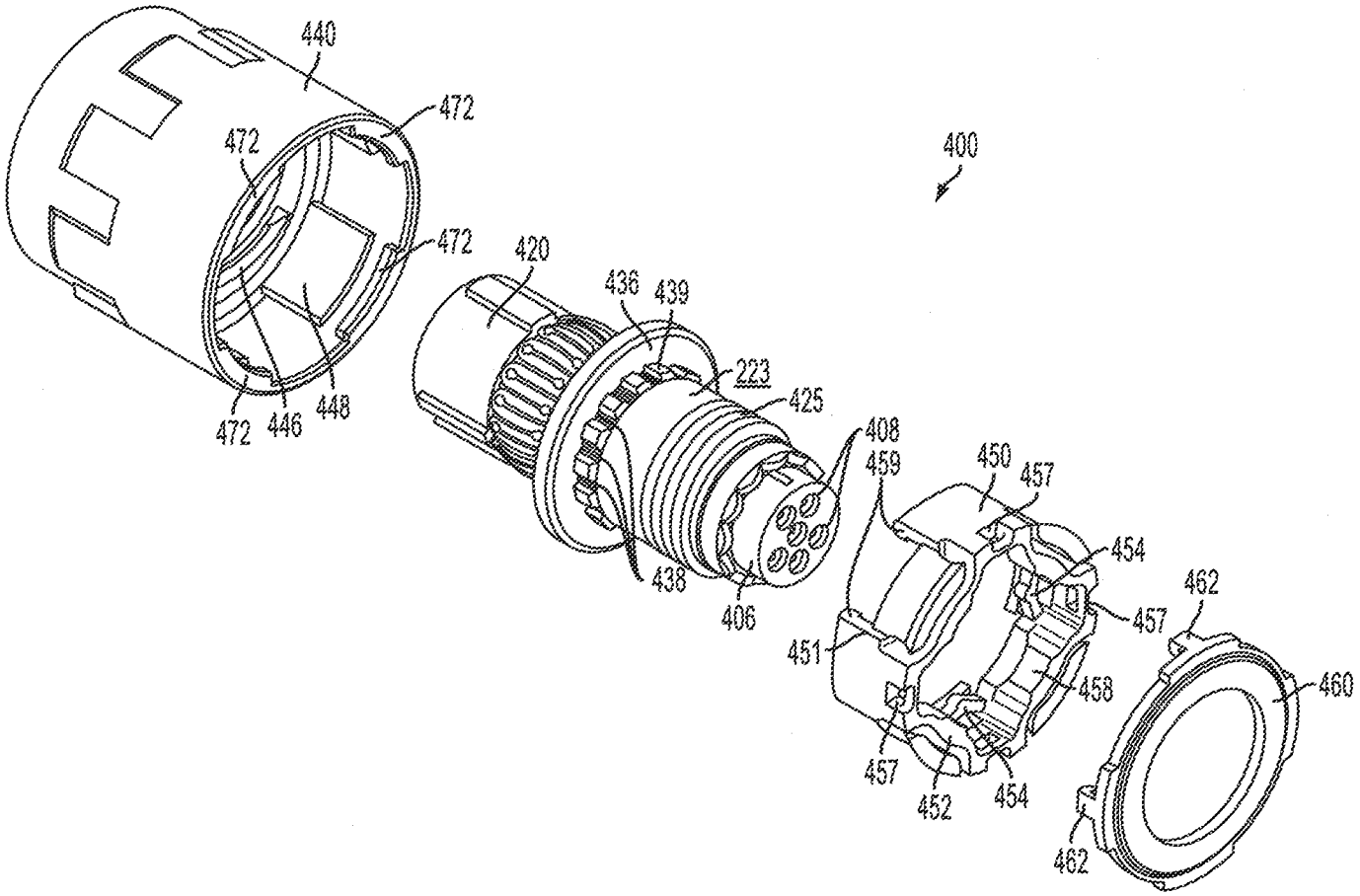
FIG. 28 is a perspective, exploded view of a circular connector, according to various embodiments of the present disclosure.

Another exemplary embodiment of a circular connector assembly 400 and various components thereof are depicted in FIG. 28. The circular connector assembly 400 can be similar in several ways to the circular connector assemblies 100, 200, and/or 300, for example, and like reference characters can refer to similar components. The reader will further appreciate that various features illustrated and/or described with respect to circular connector assembly 400 can be combined with the features of other embodiments.

The circular connector assembly 400 can include a first shell, such as shell 110 (FIGS. 1-7) or shell 210 (FIGS. 13A, 13B, and 14), for example, that houses at least one electrical contact, a second shell 420 that houses at least one corresponding electrical contact 308 (FIGS. 22-27), and a coupling nut 440 that is configured to secure the first shell and the second shell 420 together to physically connect and electrically couple the electrical contacts therein. When the first shell and the second shell 420 are assembled together, rotation of the first shell relative to the second shell 420 can be limited and/or prevented. For example, the first shell and the second shell 420 can include alignment features, which can prevent rotation of the first shell relative to the second shell 420. It may be desirable to prevent rotation of the first shell relative to the second shell 420 to maintain alignment of the electrical contacts housed therein and to prevent damage thereto, for example.

An annular insert 450 can be inserted into the coupling nut 440, and can be held in a fixed positioned relative to the coupling nut 440. Accordingly, the coupling nut 440 can include a plurality of retaining features, which can engage corresponding retaining features on the annular insert 450. In various instances, the coupling nut 440 can include axially extending retaining features and/or radially extending retaining features. For example, the coupling nut 440 includes at least one clip 459. In certain instances, the coupling nut 440 can include a plurality of clips 459, for example, which can be positioned at an end of the coupling nut 440. The clips 459 can be configured to clip around a flange 436 that radially protrudes from the second shell 420.

Additionally or alternatively, the coupling nut 440 can include at least one axially extending alignment ridge 448, which can project radially inward from the inner surface of the coupling nut 440. In certain instances, a plurality of alignment ridges 448 can extend along a portion of the length of the coupling nut 440 and can be spaced around the inner circumference of the coupling nut 440. As described in greater detail herein, the alignment ridges 448 can be dimensioned and positioned to engage alignment slots 451 defined radially inward in the annular insert 450.

The annular insert or insert ring 450 can be structured and dimensioned to fit within the coupling nut 440. Moreover, the annular insert 450 can also include radially extending and/or axially extending retaining features, which can engage corresponding features on the coupling nut 440. For example, the outer perimeter of the annular insert 420 can include at least retaining slot 451, which can securely engage one of the retaining ridges 448 defined in the coupling nut 440. Additionally or alternatively, the annular insert 450 can include alignment ridges and/or the coupling nut 440 can include corresponding alignment slots dimensioned and structured to receive the alignment ridges.

In certain instances, the annular insert 450 can be ultrasonically welded to the coupling nut 440. In such instances, the annular insert 450 and the coupling nut 440 may also include retaining features, such as the axially extending retaining features, radially extending retaining features, and/or clips described herein. In other instances, the annular insert 450 and the coupling nut 440 may not include additional retaining features.

The annular insert 450 can include an integrally molded body 452, which can form a unitary molded piece. In various instances, the body 452 can include the axially extending and/or radially extending retaining features and/or clips 459, for example. Moreover, the body 452 includes at least one flexible spring member 454, which can be integrally formed with the molded body 452. The spring member 454 can have a bowed or bow-like shape, and can bow and/or arc radially inward, for example.

The spring member 454 can further include a tooth or catch 456, which can be configured to rotatably engage the recesses 438 along the annular track 439 on the outer surface 423 of the second shell 420 as the coupling nut 440 rotates relative to the second shell 420. In various instances, a plurality of spring members 454 can be positioned around the inner perimeter of the annular insert 450 and each spring member 454 can include at least one tooth 456. In various instances, the spring members 454 and associated teeth 456 can be spaced equidistantly around the inner perimeter of the annular insert 450.

Moreover, in various instances, the annular insert 450 can include at least one guide surface 458. In various instances, each guide surface 458 can be positioned intermediate adjacent spring members 454. The guide surfaces 458 can be configured to rotatably slide along an unthreaded portion of an outer surface 423 that is intermediate an attachment portion 425 of the second shell 420 and a flange 436, as the coupling nut 440 rotates relative to the second shell 420.

The circular connector assembly 400 can also include a protective cover 460, which can conceal, cover and/or guard the annular insert 450. The protective cover 460 can include latches and/or clasps 462 for further securing the protective cover 460 to the annular insert 450 and/or to the coupling nut 440. The clasps 462 can engage apertures 457 positioned around the perimeter of the annular insert 450. Additionally or alternatively, the coupling nut 440 can include an annular lip or protruding rim 472 for further securing the protective cover 460 thereto.

To assemble, the annular insert 450 can be inserted within the coupling nut 440, and can be held in a fixed position relative to the coupling nut 440. To insert the annular insert 450 into the coupling nut 440, the alignment slots 451 of the annular insert 450 can be aligned with the alignment ridges 448 of the coupling nut 440, for example. When the alignment slots 451 are aligned with the alignment ridges 448, the annular insert 450 can move axially relative to the coupling nut 440 until the annular insert 450 is fully seated within the coupling nut 440.

When the coupling nut 440 and the annular insert 450 are assembled, the assembly 440, 450 can be secured to the second shell 420. For example, the second shell 420 can be inserted into the coupling nut 440 along the common axes thereof until the clips 459 clip and/or otherwise hold the flange 436 of the second shell 420. According, the coupling nut 440 and the annular insert 450 positioned therein can be secured in position around the second shell 420. In such instances, axial displacement of the coupling nut 440 relative to the second shell 420 can be limited and/or prevented.

The protective cover 460 can also be attached to the coupling nut 440, the insert 450 and the shell 420 assembly. For example, the protective cover can be positioned within the coupling nut and can overlie the annular insert 450, for example. The clasps 462 can engage the apertures 457 positioned around the perimeter of the annular insert 450. Additionally, the protruding rim 472 of the coupling nut 440 can further secure the protective cover 460 thereto.

When the coupling nut 440, the annular insert 450, and the second shell 420 are assembled, the teeth 456 of the spring members 454 can be arranged around an annular track 439 on the outer surface 423 of the second shell 420. Moreover, the teeth 456 can be rotatably aligned with recesses 438 in the annular track 439. In other words, as the coupling nut 440 rotates relative to the second shell 420, the teeth 456 can engage and disengage the recesses 438 in the track 439. In such instances, rotation of the coupling nut 440 relative to the second shell 420 can be permitted; however, the arrangement of the springs 454 and the recesses 438 can resist and/or control the rotation.

In various instances, as the coupling nut 440 and the annular insert 450 therein rotate in a coupling direction relative to the second shell 420, the threaded portion 446 of the coupling nut 440 can be configured to threadably engage a threaded portion on the first shell to draw the first shell toward the second shell 420. Moreover, rotation of the coupling nut 440 and the annular insert 450 in the decoupling direction can be resisted by the engagement of the spring members 454 with the recesses 438 defined in the outer surface 423 of the second shell 423. The first shell, the second shell 420, the annular insert 450, and the coupling nut 440 can be comprised of a plastic material such that metal-to-plastic contacts between the rotating components is avoided. For example, the annular insert 450 can consist of a unitary molded piece, and the spring members 454 can be integrally formed parts of the unitary molded piece.

Figure 29:
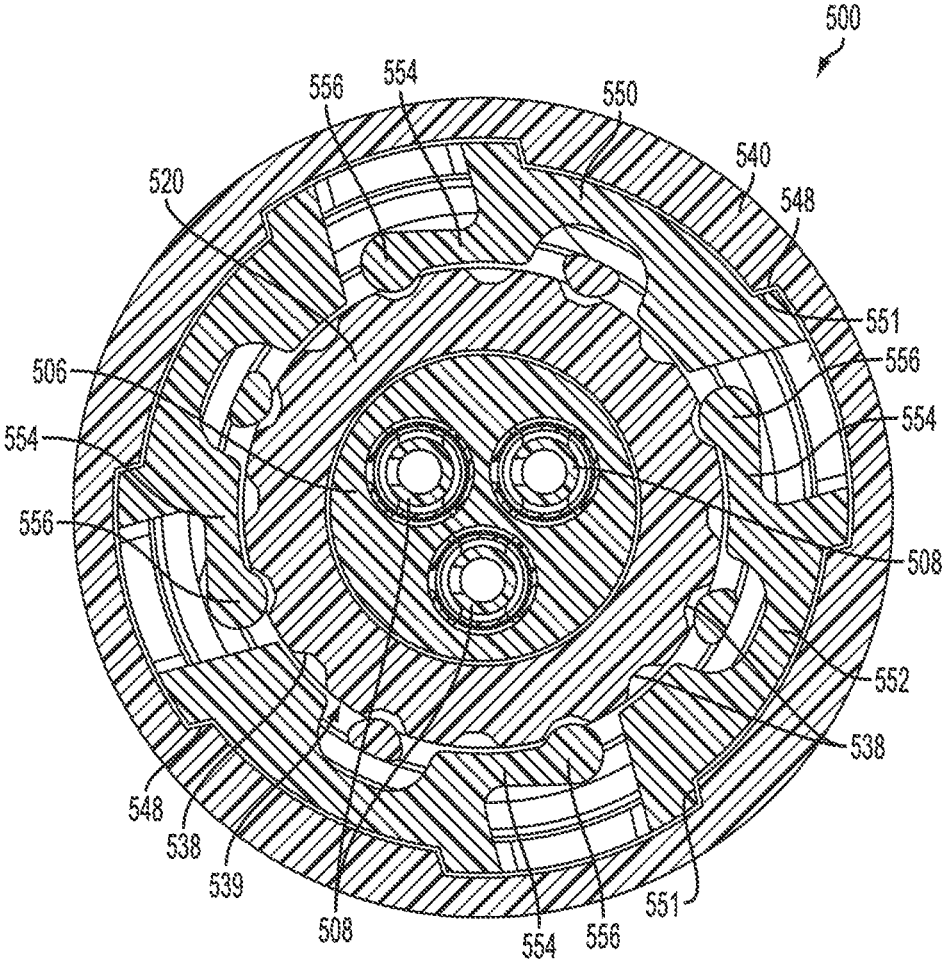
FIG. 29 is a cross-sectional, elevation view of a circular connector, according to various embodiments of the present disclosure.

Another exemplary embodiment of a circular connector assembly 500 and various components thereof are depicted in FIG. 29. The circular connector assembly 500 can be similar in several ways to the circular connector assemblies 100, 200, 300 and/or 400, for example, and like reference characters can refer to similar components. The reader will further appreciate that various features illustrated and/or described with respect to circular connector assembly 500 can be combined with the features of other embodiments.

The circular connector assembly 500 can include a coupling nut 540 and an annular insert 550, which can be positioned around a shell 520 having a housing 506 and houses electrical contacts 508 therein. Alignment features, such as ridges 551, for example, in the annular insert 550 can engage alignment features, such as grooves 548, for example, in the coupling nut 540, such that the annular insert 550 is fixed relative to the coupling nut 540. Moreover, the coupling nut 540 and the annular insert 550 can be secured to the shell 520, such that axial displacement is limited and/or prevented and rotational displacement is permitted and restrained. For example, the annular insert 550 can be snap-fit or otherwise secured relative to the shell 520. Additionally, the annular insert 550 can include at least one spring member 554, which can releasably engage a track 539 of recesses 538 defined into the outer surface 523 of the shell 520.

The annular insert 550 can include an integrally molded body 552, which forms a unitary molded piece. The body 552 can include the axially extending and/or radially extending retaining features, such as ridges 551, for example. Moreover, the body 552 can also include a plurality of spring members 554. The spring members 554 can be integrally formed with the molded body 4552. Additionally, the spring members 154 can have an arm and/or cantilevered shape. For example, each spring member 154 can include a tooth or catch 556 at the end of the spring member 154. The teeth 154 can be configured to deflect radially outward as the coupling nut 540 rotates, and then can rebound radially inward to engage the recesses 538 in the outer surface 523 of the shell 520 as the coupling nut 540 continues to rotate. In various instances, the annular insert 550 can include two or more integrally-formed spring members 554. Referring to the embodiment depicted in FIG. 29, the annular insert 150 can include four integrally-formed spring members 154. In various instances, the spring members 154 and associated teeth 156 can be equidistantly spaced around the inner perimeter of the annular insert 150.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

While this invention has been described as having exemplary designs, the present invention may be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains.

We claim:

1. An electrical connector, comprising:

a first shell comprising an external threaded portion;

a second shell comprising an outer surface, wherein the outer surface comprises an unthreaded portion, and wherein the unthreaded portion comprises a plurality of recesses arranged around an annular track;

a coupling nut comprising an internal threaded portion configured to threadably engage the external threaded portion of the first shell; and an annular insert secured relative to the coupling nut, wherein the annular insert comprises an inner surface comprising a plurality of spring-loaded teeth extending radially inward, and wherein the spring-loaded teeth are positioned around the unthreaded portion of the second shell and are rotatably aligned with the recesses in the second shell; and a biasing sleeve positioned around a portion of the outer surface of the second shell, wherein the biasing sleeve is configured to bias the external threaded portion of the first shell toward the internal threaded portion of the coupling nut when the coupling nut threadably engages the first shell.

2. An electrical connector, comprising:

a first shell comprising an external threaded portion;

a second shell comprising an outer surface, wherein the outer surface comprises a plurality of recesses arranged in an annular row; and a coupling nut, comprising:

an internal threaded portion configured to threadably engage the external threaded portion of the first shell;

a plurality of guide surfaces, wherein the guide surfaces are configured to rotatably slide along a portion of the outer surface of the second shell; and a plurality of springs, wherein each spring is positioned intermediate a pair of the guide surfaces, and wherein each spring comprises:

a first end;

a second end; and a spring-loaded tooth intermediate the first end and the second end, wherein the guide surfaces are positioned radially inward of the spring-loaded teeth, and wherein the spring-loaded teeth are rotatably aligned with the recesses in the second shell.

3. The electrical connector of claim 2, wherein the springs further comprise an arc extending radially inward between the first end and the second end.

4. An electrical connector, comprising:

a first shell comprising an external thread;

a second shell comprising an outer surface, wherein the outer surface comprises a plurality of recesses arranged along an annular row;

a coupling nut comprised of a first plastic material, wherein the coupling nut comprises an internal thread; and an annular insert comprised of a second plastic material, wherein the annular insert is fixed relative to the coupling nut, wherein the annular insert comprises an inner surface comprising a plurality of spring-loaded teeth extending radially inward, and wherein the spring-loaded teeth are aligned with the annular row in the second shell.

5. An electrical connector, comprising:

a first shell comprising an external threaded portion;

a second shell comprising an outer surface, wherein the outer surface comprises an unthreaded portion, and wherein the unthreaded portion comprises a plurality of recesses arranged around an annular track;

a coupling nut comprising an internal threaded portion configured to threadably engage the external threaded portion of the first shell; and an annular insert secured relative to the coupling nut, wherein the annular insert comprises an inner surface comprising a plurality of spring-loaded teeth extending radially inward, and wherein the spring-loaded teeth are positioned around the unthreaded portion of the second shell and are rotatably aligned with the recesses in the second shell, wherein the annular insert comprises a body and a plurality of springs, and wherein each spring further comprises:

a first end connected to the body;

a second end connected to the body; and at least one of the spring-loaded teeth intermediate the first end and the second end;

wherein the body further comprises a plurality of guide surfaces, wherein at least one guide surface is positioned intermediate adjacent springs, and wherein the guide surfaces are configured to rotatably slide along a portion of the unthreaded portion of the second shell.

6. An electrical connector, comprising:

a first shell comprising an external threaded portion;

a second shell comprising an outer surface, wherein the outer surface comprises an unthreaded portion, and wherein the unthreaded portion comprises a plurality of recesses arranged around an annular track;

a coupling nut comprising an internal threaded portion configured to threadably engage the external threaded portion of the first shell; and an annular insert secured relative to the coupling nut, wherein the annular insert comprises an inner surface comprising a plurality of spring-loaded teeth extending radially inward, and wherein the spring-loaded teeth are positioned around the unthreaded portion of the second shell and are rotatably aligned with the recesses in the second shell;

wherein the unthreaded portion of the second shell further comprises a locking rib and a flange, and wherein the annular insert is retained between the locking rib and the flange.

7. The electrical connector of claim 6, further comprising a cover positioned intermediate the annular insert and the locking rib of the second shell.

8. The electrical connector of claim 4, wherein the first plastic material and the second plastic material comprise the same plastic material.

9. The electrical connector of claim 4, wherein the coupling nut further comprises a plurality of pins, wherein the annular insert further comprises a plurality of apertures, and wherein each of the pins is positioned in one of the apertures.

10. An electrical connector, comprising:

a first shell comprising an external threaded portion;

a second shell comprising an outer surface, wherein the outer surface comprises an unthreaded portion, and wherein the unthreaded portion comprises a plurality of recesses arranged around an annular track;

a coupling nut comprising an internal threaded portion configured to threadably engage the external threaded portion of the first shell; and an annular insert secured relative to the coupling nut, wherein the annular insert comprises an inner surface comprising a plurality of spring-loaded teeth extending radially inward, and wherein the spring-loaded teeth are positioned around the unthreaded portion of the second shell and are rotatably aligned with the recesses in the second shell;

wherein the coupling nut further comprises a plurality of pins, wherein the annular insert further comprises a plurality of apertures, and wherein each of the pins is positioned in one of the apertures.

11. An electrical connector, comprising:

a first shell comprising an external threaded portion;

a second shell comprising an outer surface, wherein the outer surface comprises an unthreaded portion, and wherein the unthreaded portion comprises a plurality of recesses arranged around an annular track;

a coupling nut comprising an internal threaded portion configured to threadably engage the external threaded portion of the first shell; and an annular insert secured relative to the coupling nut, wherein the annular insert comprises an inner surface comprising a plurality of spring-loaded teeth extending radially inward, and wherein the spring-loaded teeth are positioned around the unthreaded portion of the second shell and are rotatably aligned with the recesses in the second shell;

wherein the coupling nut further comprises a plurality of axial ridges, wherein the annular insert further comprises a plurality of axial grooves, and wherein each of the axial grooves is dimensioned and positioned to receive one of the axial ridges.

* * * * *